US012679429B2

(12) United States Patent
Tunell

(10) Patent No.: US 12,679,429 B2
(45) Date of Patent: Jul. 14, 2026

(54) COUPLER, COUPLER SYSTEM HAVING A FIRST COUPLER AND A SECOND COUPLER, AND METHOD FOR COUPLING

(71) Applicant: Dellner Couplers AB, Falun (SE)

(72) Inventor: Fredrik Tunell, Falun (SE)

(73) Assignee: Dellner Couplers AB, Falun (SE)

( * ) Notice: Subject to any disclaimer, the term of this patent is extended or adjusted under 35 U.S.C. 154(b) by 885 days.

(21) Appl. No.: 17/858,828

(22) Filed: Jul. 6, 2022

(65) Prior Publication Data

US 2023/0027765 A1 Jan. 26, 2023

(30) Foreign Application Priority Data

Jul. 21, 2021 (EP) ..... 21187039
Sep. 29, 2021 (EP) ..... 21199945

(51) Int. Cl.
*B61G 3/16* (2006.01)
*B61G 5/04* (2006.01)
*B61G 7/10* (2006.01)

(52) U.S. Cl.
CPC ..... *B61G 3/16* (2013.01); *B61G 5/04* (2013.01); *B61G 7/10* (2013.01)

(58) Field of Classification Search
CPC ..... B61G 3/16; B61G 5/04; B61G 7/10
See application file for complete search history.

(56) References Cited

U.S. PATENT DOCUMENTS

| | | | |
|---|---|---|---|
| 3,655,066 | A | 4/1972 | Metzger |
| 4,627,545 | A | 12/1986 | Herbert et al. |
| 5,139,161 | A | 8/1992 | Long |
| 5,509,548 | A | 4/1996 | Kreher |
| 7,497,345 | B2 | 3/2009 | Brabb et al. |
| 9,527,517 | B2 | 12/2016 | Westman et al. |
| 2007/0084818 | A1 | 4/2007 | Brabb et al. |

FOREIGN PATENT DOCUMENTS

| | | | | |
|---|---|---|---|---|
| AU | 676613 | B2 | 3/1997 | |
| CN | 102991526 | A | 3/2013 | |
| DE | 9418999 | U1 | 2/1995 | |
| DE | 4402530 | A1 | 8/1995 | |
| EP | 0652149 | A1 | 5/1995 | |
| EP | 0652149 | B1 * | 12/1996 | ..... B61G 3/16 |
| GB | 2583475 | A | 11/2020 | |

OTHER PUBLICATIONS

Extended European Search Report received in European Application No. 21199945.3, mailed on Aug. 24, 2022, 7 pages.

* cited by examiner

*Primary Examiner* — Robert J McCarry, Jr.
(74) *Attorney, Agent, or Firm* — Howard IP Law Group, PC

(57) ABSTRACT

A coupler having a coupler interface comprising a protruding cone, a matching cup, and at least one guiding element useful for reducing coupler height.

17 Claims, 18 Drawing Sheets

COUPLER, COUPLER SYSTEM HAVING A FIRST COUPLER AND A SECOND COUPLER, AND METHOD FOR COUPLING

FIELD OF THE INVENTION

The invention relates to a coupler. The invention also pertains to a coupler system having a first coupler and having a second coupler. The invention also pertains to a method for coupling a first coupler of a coupler system to the second coupler of the coupler system.

BACKGROUND

Couplers are known from everyday life for coupling a first car of a multicar vehicle, for example a railway train, to a second car of this multicar vehicle. Often a coupler is connected to the one car and intended to couple with a further coupler, which further coupler is attached to the second car; the connection between the first car and the second car hence being made by the coupler of the first car engaging with the coupler of the second car. Typically, a connection between a first car of a multicar vehicle to a second car of a multicar vehicle by way of couplers is intended to be a releasable connection. Hence while the couplers have a first operating condition, where they are connected to each other in a manner to transmit forces between the two cars, the couplers can be brought into a further operating condition, where they are separated apart and not connected to each other anymore.

One design of a coupler suitable to connect a first car of a multicar vehicle to a coupler of a second car of the multicar vehicle as known from everyday life is shown in FIG. 1. The coupler from the prior art as shown in FIG. 1 has a coupler interface 5 that comprises a protruding cone 3 and a matching cup 4. In the prior art design, a guiding horn 1 is arranged below the cone 3 and the cup (funnel) 4. The coupler shown in FIG. 1 has a coupler interface with a geometry that in this field of technology often is referred to as "Scharfenberg" (German term: "Automatische Kupplung; Bauart Scharfenberg"). This coupler in the industry is often referred to as "type 10".

In "Blatt 4" of DIN 25 605, in the version of July 1970 this type of coupler is also shown.

In the coupler known from the prior art as shown in FIG. 1 or as shown in "Blatt 4" of DIN 25 605 as referenced above, the guide horn 1 is used to guide the coupler of the other car to which the respective coupler is to be coupled towards the cone 3 and the matching cup 4. Typically, in case of a misalignment of the two couplers, the guide horns 1 would come into contact with each other and due to their specific three dimensional shape would slide along each other and bring the two couplers into alignment.

Couplers of the type shown in FIG. 1 and in "Blatt 4" of DIN 25 605 in the version of July 1970 are often supplemented by an electrical coupler that is arranged on top of the coupler interface 5 shown in FIG. 1 (above the coupler interface 5). This design known from everyday life due to its particular constraints is subject to height requirements, namely requiring a specific volume to be provided in the car to be taken up by a coupler of this design. Especially, this design limits the ability to bring the coupler interface closer to the underframe of the car in the sense of bringing it further upwards towards the underframe of the car. Due to the electrical coupler arranged on top of the coupler, the coupler interface cannot be brought any closer to the underframe of the car.

SUMMARY

The problem to be solved by the invention is to provide a coupler that is more versatile in its application and can be used in many different arrangements relative to the respective car it is to be connected to.

This problem is solved by one or more of a coupler, coupler system, multi-car vehicle and method for coupling according to embodiments of the present disclosure. Preferred embodiments are described in the description following hereafter.

Embodiments or aspects of the invention provide a coupler having an interface or front face. Aspects of the invention are described, each of which may be independent and patentable on its own. In addition, several or all of the aspects can be combined.

The coupler, especially the coupler interface or front face, may comprise a protruding cone and a matching cup or funnel. The coupler, especially the coupler interface, may have a geometry which may be of the built-type "Scharfenberg" (German term: "Automatische Kupplung; Bauart Scharfenberg"), for example the coupler that have become known in the industry under the abbreviation "type 10".

According to an aspect of the invention, the problem is solved by providing a guiding element that is provided with the coupler interface in one piece. While in the prior art design according to FIG. 1 and according to "Blatt 4" of DIN 25 605 the guide horn 1 is provided as separate element to the coupler interface, providing a guiding element in one piece with the coupler interface provides for advantages in the manufacturing of the coupler, because the guiding element can now be produced in the same production step as the coupler interface. Additionally, providing a guiding element as one piece with the coupler interface allows for the guiding element to be made more robust.

The coupler according to embodiments or aspects of the invention has a coupler interface that comprises a protruding cone and a matching cup. The matching cup also sometimes is referred to as funnel. According to an aspect of the invention, the coupler comprises a coupler interface comprising a protruding cone, a matching cup, and at least one guiding element useful for reducing coupler height.

The term "coupler interface" refers to the group of elements of the coupler that is intended to engage with a further coupler and that take part in connecting the one coupler with the other coupler. In a preferred embodiment, the coupler interface in addition to the protruding cone and the matching cup has a front piece that provides a front surface. The front surface is the forward facing surface of the front piece. The cone can be provided as an element that protrudes from the front piece, especially protrudes from the front surface. The cup can be provided as an element that recesses from the front piece, especially recesses from the front surface. In a preferred embodiment, the front piece is a wall or is a plate-shaped element.

In a preferred embodiment, the coupler has a rear end, which rear end is intended to be connected to a car of a multi-car vehicle, for example to a car of a train. In this context, the front is considered to be the opposite end of the rear end. In this context the "forward direction" or "forward" is intended to refer to a direction that is pointing away from the rear end and/or is pointing into the opposite direction to a direction that points towards the rear end.

In a preferred embodiment, the front surface of the front piece has at least one surface section which is flat. The front surface may comprise several surface sections that each is flat. In a preferred embodiment, some of the surface sections that are flat can be arranged in the same plane. Designs are feasible, where some of the surface sections that are flat are arranged in a first plane and other of those surface sections that are flat are arranged in a different plane. In a preferred embodiment, the first plane and the different plane are parallel to each other.

In a preferred embodiment the front surface of the front piece has a group of flat surface sections, whereby each flat surface of the group of flat surfaces is

- either arranged in a first plane
- or a second plane that is arranged parallel to the first plane, but further away from the rear end than the first plane
- or in a plane that is parallel to the first plane and parallel to the second plane and arranged between the first plane and the second plane.

In a preferred embodiment, the group of flat surfaces comprises all forward facing flat surfaces of the front surface. In a preferred embodiment, the distance between the first plane and the second plane is larger than 0.5 millimeters (mm), preferably larger than 3 mm, preferably larger than 4 mm, preferably larger than 5 mm. In a preferred embodiment, the distance between the first plane and the second plane is smaller than 20 mm, preferably smaller than 15 mm, preferably smaller than 13 mm, preferably smaller than 10 mm.

In a preferred embodiment, the front surface of the front piece has a quadratic or a rectangular or a circular or an elliptical shape. Through holes may be provided in the front piece. The through holes can be used for brake pipes.

In a preferred embodiment, the front piece is one piece. In a preferred embodiment, the front piece is a part of a basic piece of the coupler. In a preferred embodiment, the coupler may have a basic piece that is formed by way of casting. The basic piece may contain the rear end, an intermediate part and the front piece, whereby the intermediate part is arranged between the rear end and the front piece. The intermediate part may be cone-shaped, may be shaped like a truncated-cone, may be pyramid-shaped or may be shaped like a truncated pyramid.

In a preferred embodiment, the front piece that has the front surface forms part of the basic piece and is created as part of the basic piece during casting. In an alternative, the front piece can be produced as an individual, separate piece to the basic body and can be attached to the basic body by way of welding or by way of screwing, for example can be attached to the intermediate part by way of welding or by way of screwing.

According to embodiments or aspects of the invention, the coupler interface has at least one guiding element. The guiding element is provided to interact with another coupler that the coupler according to the invention is to interact with.

The guiding element in a preferred embodiment is an element that protrudes from the front surface of the front piece, which will be called "a protruding guiding element". Already by being designed to protrude from the front surface of the front piece, the guiding element can operate as a guide element, because the other coupler can come into contact with the guiding element prior to coming into contact with the front surface. Hence in the broadest sense, a "guiding element" can be any element that protrudes from the front surface of a front piece and that is not the protruding cone, but that is—according to an aspect of the invention—provided as one piece with the coupler interface, especially provided as one piece with the front piece and hence is not the separate guide horn that is known from the prior art.

According to a first aspect of the invention, the height of the coupler from a center line of the coupler interface to the top of the coupler interface, especially to the top of the front piece, especially to the top of the front surface is smaller than 300 mm, preferably smaller than 275 mm, preferably smaller than 250 mm, preferably smaller than 225 mm, preferably smaller than 200 mm. In addition, or as an alternative, the height of the coupler from a center line of the coupler interface to the bottom of the coupler interface, especially to the bottom of the front piece, especially to the bottom of the front surface is smaller than 300 mm, preferably smaller than 275 mm, preferably smaller than 250 mm, preferably smaller than 225 mm, preferably smaller than 200 mm. In a preferred embodiment, the center line of the coupler interface is the horizontal line that goes through the middle of the front piece in the sense that it is arranged at the same distance from the highest point of the front piece and the lowest point of the front piece. In a preferred embodiment, where the front piece is quadratic, rectangular, circular or of elliptical shape, the center line in these preferred designs preferably being a line of symmetry of the square, the rectangle, the circle or the ellipse. In a preferred embodiment, the center line is the line of inter-section between the front surface of the front piece and a horizontal plane, which horizontal plane is the plane of symmetry of the protruding cone and/or the plane of symmetry of the matching cup and/or the plane of symmetry of a circular recess that constitutes the start of the cup in the front surface.

In a preferred embodiment, the protruding cone at the place where it protrudes forward from the front piece has a circular cross-section and a diameter of more than 70 mm, preferably more than 80 mm, preferably more than 90 mm, preferably more than 100 mm. In a preferred embodiment, the protruding cone at the place where it protrudes forward from the front piece has a circular cross-section and a diameter of less than 300 mm, preferably less than 280 mm, preferably less than 260 mm, preferably more than 250 mm. In a preferred embodiment, the matching cup at the place, where it starts to recess from the front piece has circular cross-section and a diameter of more than 70 mm, preferably more than 80 mm, preferably more than 90 mm, preferably more than 100 mm. In a preferred embodiment, the matching cup at the place, where it starts to recess from the front piece has circular cross-section and a diameter of less than 300 mm, preferably less than 280 mm, preferably less than 260 mm, preferably more than 250 mm.

Because the invention allows for the guide horn known from the prior art design (FIG. 1) to be done away with, the invention allows for the coupler interface to be generally reduced in height. The additional height needed for the guide horn in the prior art design can be done away with or used for other elements of the coupler, for example an electric coupler.

According to a second aspect of the invention which may be combined with the first aspect of the invention, the at least one guiding element is provided with the coupler interface in one piece.

In a preferred embodiment, the coupler interface is casted and the at least one guiding element is formed during casting. In a preferred embodiment, the at least one guiding element is formed during casting together with the coupler interface.

In a preferred embodiment, the guiding element is provided as one piece with a front piece of the coupler. Designs are feasible, where individual parts of the coupler interface are not made as one piece. For example, the matching cup of the coupler interface may be provided by way of machining a hole into the front piece, especially into the front surface of the front piece. As an additional example, the protruding cone may be attached to the front piece, especially the front surface of the front piece at a later production step.

According to a third aspect of the invention that may be combined with the first aspect and/or the second aspect of the invention, the coupler has an electrical connector, whereby the electrical connector is arranged on the lower side of the coupler interface. While the prior art designs had the electrical coupler arranged on the top of the coupler interface, because below the coupler interface the guide horn was arranged, the coupler according to embodiments and aspects of the invention makes it possible to do away with the guide horn and therefore provides additional space below the coupler interface that can be used to place the electrical connector on the lower side of the coupler interface.

In a preferred embodiment, the electrical connector is a square connector that includes a multitude of individual electrical and/or hydraulic and/or pneumatic connections. In a preferred embodiment, the width of the electrical connector (the width being understood as the extent in the horizontal, sideways direction) of the electrical coupler is at least 30%, preferably at least 50%, preferably at least 60%, preferably at least 75% of the width of the coupler interface and/or of the front piece of the coupler interface and/or of the front surface of the front piece of the coupler interface. In a preferred embodiment, the height of the electrical connector (the height being understood as the extent in the vertical, up- and downwards direction) of the electrical coupler is at least 30%, preferably at least 50%, preferably at least 60%, preferably at least 75% of the height of the coupler interface and/or of the front piece of the coupler interface and/or of the front surface of the front piece of the coupler interface.

In a fourth aspect of the invention that may be combined with the first aspect of the invention and/or maybe combined with the second aspect of the invention and/or may be combined with the third aspect of the invention, the coupler has at least one guiding element, which is arranged lateral to the protruding cone and the matching. Lateral is understood to be arranged to the side of the protruding cone and the matching cup in a horizontal direction.

In a preferred embodiment, the coupler interface has two guiding elements, preferably only has two guiding elements, whereby each of the two guiding elements is arranged lateral to the protruding cone and the matching cup.

According to this fourth aspect of the invention, the guiding element is moved from a place below the coupler interface to the side of the coupler interface. As has been found out by the inventors, a lateral guiding element or if several, for example two guiding elements are provided, having several guiding elements arranged lateral of the protruding cone and the cup still allows for the guiding of the further coupler towards the coupler and to assist in a beneficial way for the coupling of the couplers. However, the placement of the guiding element/guiding elements lateral to the cone and the cup, in comparison to below the coupler interface, provides for new space below the coupler interface, for example for arranging an electrical connector below the coupler interface and/or for generally making the coupler interface slimmer in the height-wise direction.

According to a fifth aspect of the invention, that may be combined with the first aspect of the invention and/or may be combined with the second aspect of the invention and/or may be combined with the third aspect of the invention and/or may be combined with the fourth aspect of the invention, the coupler has at least one guiding element and this guiding element is designed to be

- symmetric to an axis connecting the mid of the cone and the mid of the cup, preferably a horizontal axis that connects the mid of the cone and the mid of the cup and/or
- symmetric relative to a horizontal plane that contains the mid of the cone and/or contains the mid of the cup.

In a preferred embodiment, the protruding cone has the shape of a cone or the shape of a truncated cone or has the shape of a pyramid or a truncated pyramid. In a preferred embodiment, the protruding cone has the shape of the protruding cone of the coupler as shown in Blatt 4 of DIN 25 605, the disclosure of which is incorporated into this description by way of reference for a specific geometric shape of the protruding cone.

In a preferred embodiment, the protruding cone extends along a cone axis. In a preferred embodiment where the cone has a circular cross section at the place where it joins the front piece, the cone axis is the center axis of this circular cross section. In a preferred embodiment, the cup has a cup axis, which is parallel to the cone axis. In those preferred embodiments where the cup has a circular shape at its starting point on the front surface, the cup axis is the center line of this circle. In a preferred embodiment the coupler has a longitudinal axis that extends from the rear end to the coupler interface and especially to the front piece of the coupler interface. In a preferred embodiment the front surface, especially the flat surface sections of the front surface are arranged in a plane or are arranged in planes that are perpendicular to the longitudinal axis. In a preferred embodiment the cone axis and/or the cup axis are parallel to the longitudinal axis.

In an embodiment, where the protruding cone has the shape of a truncated cone, the truncated cone preferably has a face surface, preferably a plane face surface. In a preferred embodiment, the mid of the cone is the point of inter-section between the cone axis and the plane in which the face surface of the truncated cone lies. For an embodiment, where the protruding cone is made as a cone with a tip and not as a truncated cone, the mid of the cone preferably is the point at the tip of the cone. Preferably the cone axis runs through the tip of the cone. For those embodiments where the cone has a circular cross section at the place where it starts to protrude from the front surface, the mid of the cone is the center of this circle.

The protruding cone can have a moveable hook that can be moved sideways out of the cone towards the cup, preferably in a rotational manner. Such a hook can be used to hook the one coupler to a further coupler that the one coupler is to be coupled with.

In a preferred embodiment, the cup has the inverted shape of the cone. In a preferred embodiment the cup is larger than the cone. Typically, the cup of a coupler is intended to take up the protruding cone of a further coupler that the respective coupler is to be coupled with. Hence, if the cup of the one coupler is designed to be the geometric inverse of the protruding cone, this will ensure that the respective coupler can be coupled with a further coupler of the identical design. In such a process, the protruding cone of the further coupler will be inserted into the cup of the respective coupler.

In a preferred embodiment, the cup has a sideways opening, which is designed to take up a hook that protrudes sideways from the protruding cone of the further coupler and is intended to interlock with the respective coupler by way of being moved sideways out of the protruding cone of the further coupler and into the sideways opening that is provided for it in the cup of the respective coupler. In a preferred embodiment, the sideways opening is arranged at that side of the cup that is closest to the cone. In a preferred embodiment the sideways opening opens towards a space behind the cone.

In a sixth aspect of the invention, that may be combined with the first aspect of the invention and/or may be combined with the second aspect of the invention and/or may be combined with the third aspect of the invention and/or may be combined with the fourth aspect of the invention and/or may be combined with the fifth aspect of the invention, the coupler has two guiding elements, which are designed to complement each other. In a preferred embodiment, the first guiding element of the two guiding elements is a protruding guiding element and in the second guiding element of the two guiding elements is a socket that is provided between a top plate and a bottom plate.

In a preferred embodiment the coupler interface only has two guiding elements. In a preferred embodiment the coupler interface only has a protruding guiding element and a guiding element as a socket.

In a preferred embodiment the protruding guiding element is arranged closer to the cup than to the cone. In a preferred embodiment the socket (or clamp-like) guiding element is arranged closer to the cone than to the cup.

In a preferred embodiment, the socket can be further delimited by a side plate, whereby in a preferred embodiment, the side plate passes over into the front surface of a front piece of the coupler interface. In a preferred embodiment, the socket is open towards the side.

In a preferred embodiment, the side panel that provides the side limitation to the socket that passes over into the front surface of the front piece of the coupler interface is a flat surface or has a flat surface that runs at an angle to the front surface of the front plate. Preferably, the surface runs backwards from the front surface into a direction towards the rear end.

In a preferred embodiment, the protruding guiding element has a cone shape or has a truncated cone shape or has the shape of a pyramid or at least for three sides of its geometric shape form together a part of the shape of a pyramid.

In a seventh aspect of the invention, that may be combined with the first aspect of the invention and/or may be combined with the second aspect of the invention and/or may be combined with the third aspect of the invention and/or may be combined with the fourth aspect of the invention and/or may be combined with the fifth aspect of the invention and/or may be combined with the sixth aspect of the invention the coupler interface has at least one guiding element, which comprises at least one guide surface that spans a plane.

In a preferred embodiment, the at least one guiding element, that comprises at least one guide surface that spans a plane, is a protruding guiding element that has two flat guide surfaces that run at an angle relative to each other. Preferably the two flat guide surfaces of the protruding guiding element run at an angle towards a horizontal plane, preferably run at the same, but inverse angle to the horizontal plane, preferably run at the same angle to a horizontal plane that contains the mid of the cone and/or the mid of the cup. Preferably the two flat guide surfaces of the protruding guiding element meet in said horizontal plane forming a front edge that has an edge line that runs along the plane, preferably at least partially is a linear edge line. In an alternative an intermediate guide surface is arranged between the respective one of the two flat guide surface a front edge. In a preferred embodiment the intermediate guide surface is a flat surface. In a preferred embodiment the intermediate guide surface has a triangular shape.

In a preferred embodiment, the protruding guiding element has a third guide surface that is arranged symmetrically about a horizontal plane and is arranged in a vertical plane. Preferably the vertical plane is arranged at an angle to the linear axis of the coupler. In a preferred embodiment, the third guide surface has edges that connect the third guide surface with the other two guide surfaces. In an alternative an intermediate guide surface is arranged between the third guide surface and the one of the other two guide surfaces. In a preferred embodiment the intermediate guide surface is a flat surface. In a preferred embodiment the intermediate guide surface has a rectangular shape. In a preferred embodiment the third guide surface has a triangular shape.

In a preferred embodiment, the protruding guiding element has a fourth guide surface that is arranged symmetrically about a horizontal plane and is arranged in a vertical plane. Preferably the vertical plane is arranged parallel to the linear axis of the coupler. In an alternative embodiment the vertical plane may be arranged at an angle to the linear axis of the coupler and preferably at an angle to the vertical plane in which the third guide surface is arranged in. In a preferred embodiment, the fourth guide surface has edges that connect the fourth guide surface with the other two guide surfaces. In a preferred embodiment, the fourth guide surface has an edge that connect the fourth guide surface with the third guide surfaces. In a preferred embodiment the edge that connect the fourth guide surface with the third guide surfaces is a crest. In a preferred embodiment the fourth guide surface is arranged closer to the front surface of a front piece of the coupler than the third guide surface. In a preferred embodiment the fourth guide surface joins the front surface at an interface line. In a preferred embodiment the interface line at least partially is a linear line. In a preferred embodiment the fourth guide surface has a shape of a trapezium.

In an eighth aspect of the invention, that may be combined with the first aspect of the invention and/or may be combined with the second aspect of the invention and/or may be combined with the third aspect of the invention and/or may be combined with the fourth aspect of the invention and/or may be combined with the fifth aspect of the invention and/or may be combined with the sixth aspect of the invention and/or may be combined with the seventh aspect of the invention, the coupler interface has at least one guiding element which has a clamp-like design. Such a clamp-like design can be provided by the guiding element having the shape of a socket.

In a preferred embodiment, a damper and/or a deformation tube are provided as part of the rear end of the coupler or attached to the rear end of the coupler.

In a preferred embodiment parts of the coupler, especially parts of the coupler interface, especially several or preferably all of the elements consisting of the group of front piece, protruding cone, guiding element or guiding elements, if several guiding elements are provided, are produced from the same material. In a preferred embodiment this material is cast metal, preferably cast steel, preferably cast iron.

In a preferred embodiment a guide horn is arranged at a lower side corner of the coupler interface and forms part of the one guiding element. In a preferred embodiment the guide horn protrudes along a horn axis, whereby the horn axis is arranged in a vertical plane, but at an angle to the horizontal plane. Preferably the angle to the horizontal plane is larger than 10°, preferably larger than 15°, preferably larger than 20°. Preferably the angle to the horizontal plane is smaller than 85°, preferably smaller than 75°, preferably smaller than 60°.

In a preferred embodiment, the horn has a side surface that is arranged in a vertical plane.

In a preferred embodiment, the guide horn has a tip. In a preferred embodiment, the horn has a side surface that is arranged in a vertical plane, whereby the tip is arranged in the same vertical plane.

In a preferred embodiment, the guide horn protrudes from the front surface of the front piece. In a preferred embodiment, the width of the guide horn decreases with distance from the front surface. In a preferred embodiment the guide horn has a triangular top surface. One side of the triangular top surface can also be designed to be bow-shaped or curved.

In a preferred embodiment all elements of the guide horn are arranged on one side of a vertical plane, whereby the cup is arranged on the other side of the vertical plane and the vertical plane contains the cone axis. In a preferred embodiment all elements of the guide horn are arranged on one side of a vertical plane, whereby the cup and the cone are arranged on the other side of the vertical plane. In a preferred embodiment, no guide horn is arranged between a first vertical plane that dissects the cone and a second vertical plane that dissects the cup. In a preferred embodiment, no guide horn is arranged between a first vertical plane that dissects the mid of the cone and a second vertical plane that dissects the mid of the cup.

In a preferred embodiment, the guide horn forms the lower part of the guiding element that has a clamp-like design, especially the shape of a socket.

In a preferred embodiment an additional guiding element is provided below the front surface and next to the electrical connector.

In a preferred embodiment, the guide horn being a part of the guiding element is a part of a unitary coupler interface and preferably is produced by way of casting together with the other elements of the coupler interface.

In a preferred embodiment the cup at its interaction with the front surface has a generally circular shape, the circular shape being supplemented by pocket shaped recesses into the front surface. The pocket shape recesses may be pointed pockets that start at a starting point and expand from the starting point towards the circular shape of the cup, the pointed pockets preferably having their largest width at the intersection with the circular shape of the cup. In a preferred embodiment a radial line to the circular shape of the cup that also intersects the starting point of the pointed pockets is arranged at an angle of 30° to 60°, preferably at 40° to 50° to the horizontal plane that runs through the center of the circular shape of the cup. The pockets can accommodate the tip of the cone of the further coupler that the coupler is to be coupled with in scenarios where said tip of the cone is guided diagonally from the top or the bottom towards the cup.

Embodiments and aspects of the invention also pertain to a coupler system with a first coupler according to the invention and a second coupler according to the invention, whereby the protruding cone of the first coupler is arranged in the cup of the second coupler and the protruding cone of the second coupler is arranged in the cup of the first coupler.

In a preferred embodiment the first coupler has a protruding cone that has a hook that protrudes sideways out of the cone and into a sideways opening of the cup of the second coupler into a space behind the cone of the second coupler.

In a preferred embodiment the second coupler has a protruding cone that has a hook that protrudes sideways out of the cone and into a sideways opening of the cup of the first coupler into a space behind the cone of the first coupler.

Embodiments and aspects of the invention also pertain to a multicar vehicle with a first car and a second car and a coupler system according to the invention, where by the first coupler is attached to the first car, preferably to the underframe of the car and the second coupler is attached to the second car, preferably to the underframe of the car.

Embodiments and aspects of the invention also pertain to a method for coupling the first coupler of a coupler system according to the invention with a second coupler of the coupler system according to the invention. The method containing the steps of

- providing the first coupler and the second coupler, whereby the first coupler is spaced apart from the second coupler,
- moving the first coupler towards the second coupler and/or moving the second coupler towards the first coupler,
- bringing
  - a. the protruding cone of the first coupler into contact with a guiding element of the second coupler and/or
  - b. the protruding cone of the second coupler into contact with a guiding element of the first coupler and/or
  - c. bringing a guiding element of the first coupler into contact with a guiding element of the second coupler,
- further moving the first coupler towards the second coupler and/or further moving the second coupler towards the first coupler,
- moving the protruding cone of the first coupler into the matching cup of the second coupler and the protruding cone of the second coupler into the matching cup of the first coupler.

In a preferred embodiment the method contains the further method step of moving a hook on a cone of the first coupler into a position where the hook protrudes sideways out of the protruding cone and into a sideways opening of the cup of the second coupler into a space behind the cone of the second coupler.

In a preferred embodiment, the first coupler and the second coupler each have two guiding elements which are designed to complement each other, namely a first guiding element and a second guiding element, especially a protruding guiding element and a socket, and in this preferred embodiment, the method step of bringing a guiding element of the first coupler into contact with a guiding element of the second coupler, is performed by bringing the first guiding element of the first coupler into contact with the second guiding element of the second coupler, especially preferred is performed by bringing a protruding guiding element of the first coupler into contact with a socket-type guiding element of the second coupler.

BRIEF DESCRIPTION OF THE DRAWINGS

In the following the invention will be explained with reference to Figures that only show exemplary embodiments of the invention.

DETAILED DESCRIPTION

Figure 1:
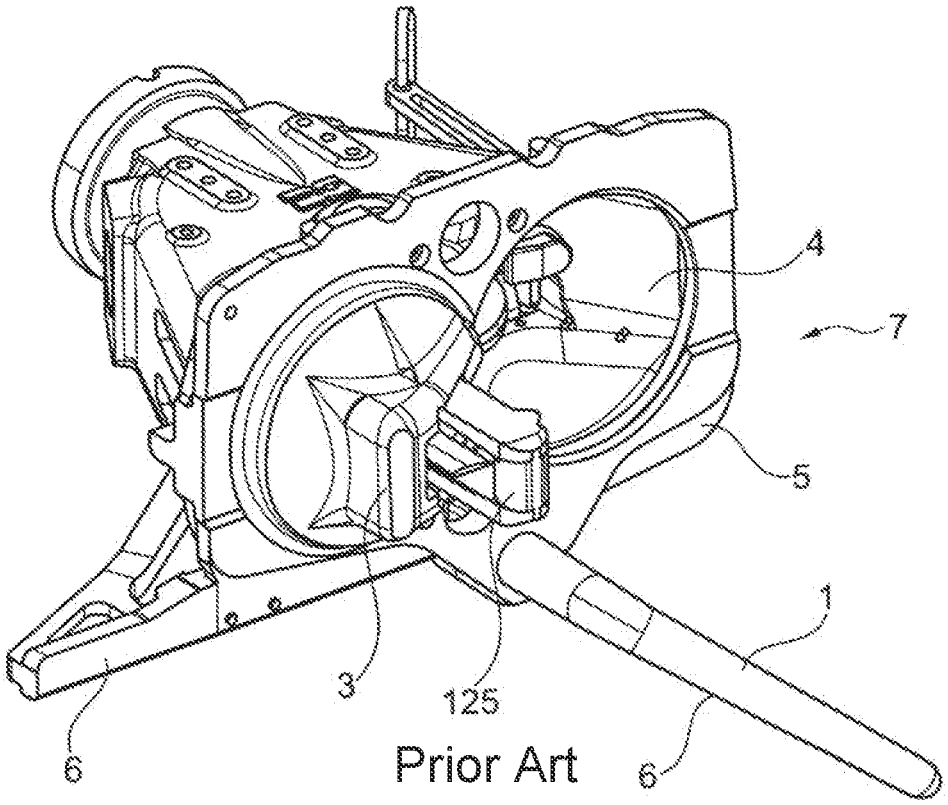
Prior Art Fig. 1
FIG. 1 shows a coupler having a coupler interface according to the prior art.

FIG. 1 shows a coupler 7 having a front surface 5. The front surface 5 comprises a cone 3 and a funnel 4 or cup. A guiding horn 1 is arranged below the cone 3 and the funnel 4.

Figure 2:
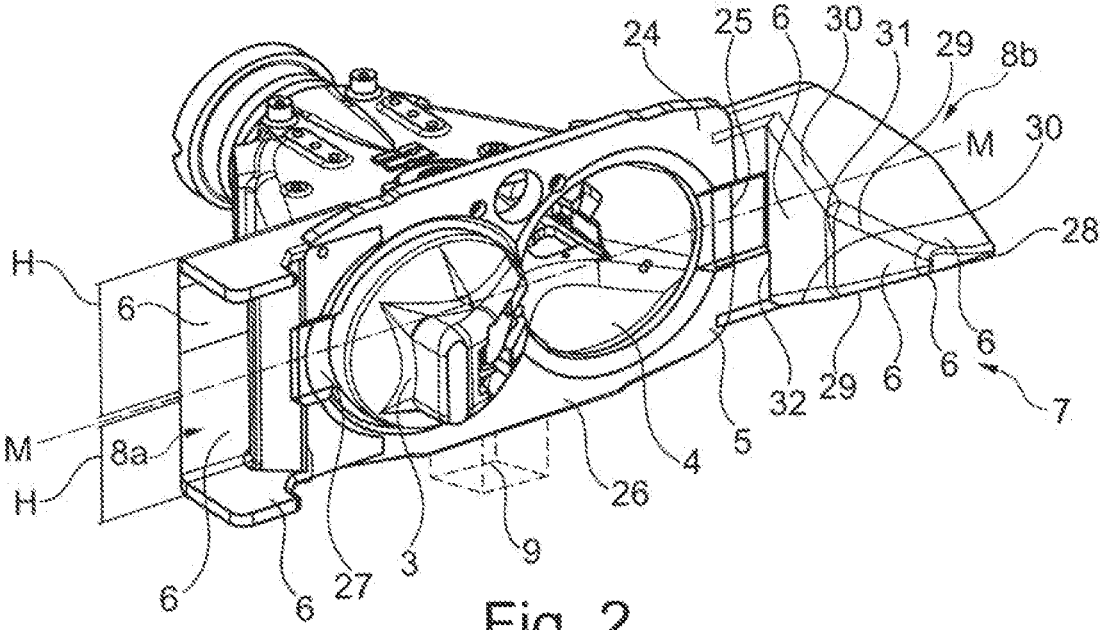
FIG. 2 shows a coupler having a coupler interface according to an embodiment of the invention.
Figure 3:
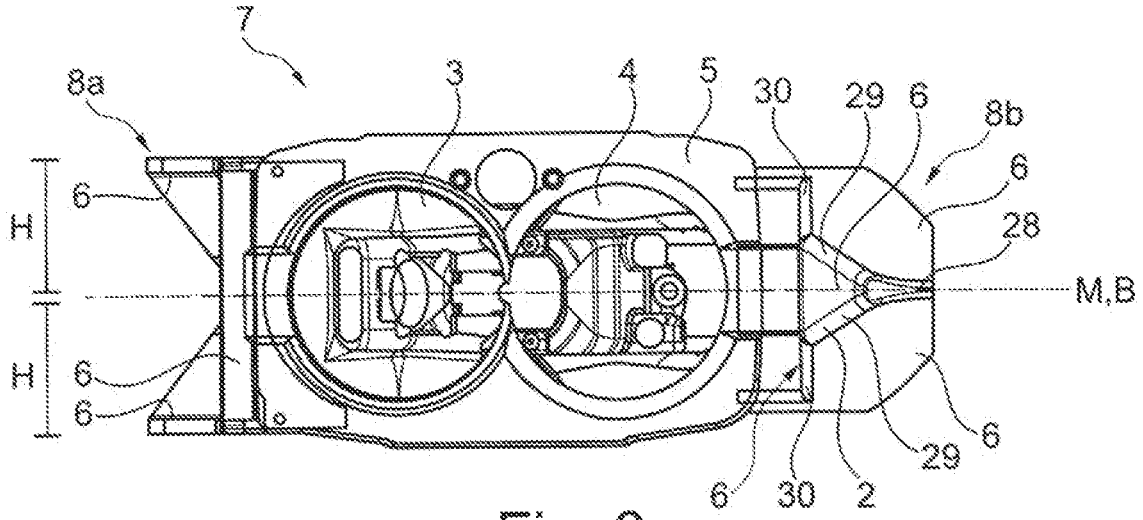
FIG. 3 shows a front view onto a coupler according to an embodiment of the invention.
Figure 4:
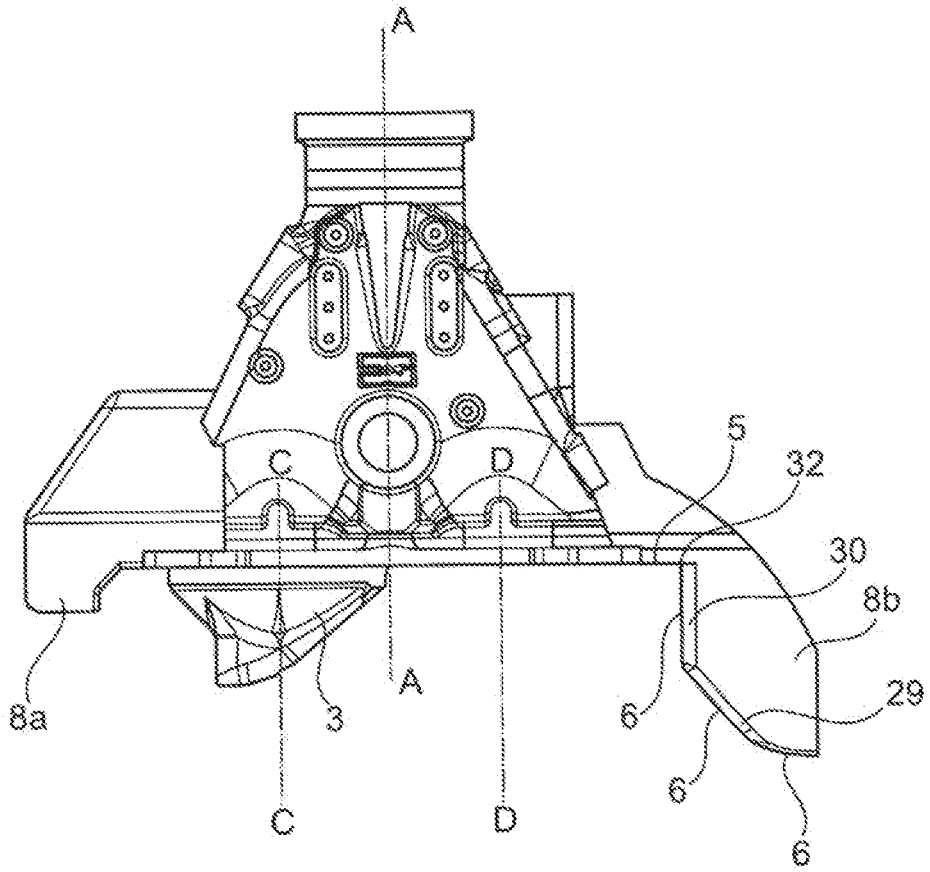
FIG. 4 shows a top view onto the coupler of FIG. 3.
Figure 5:
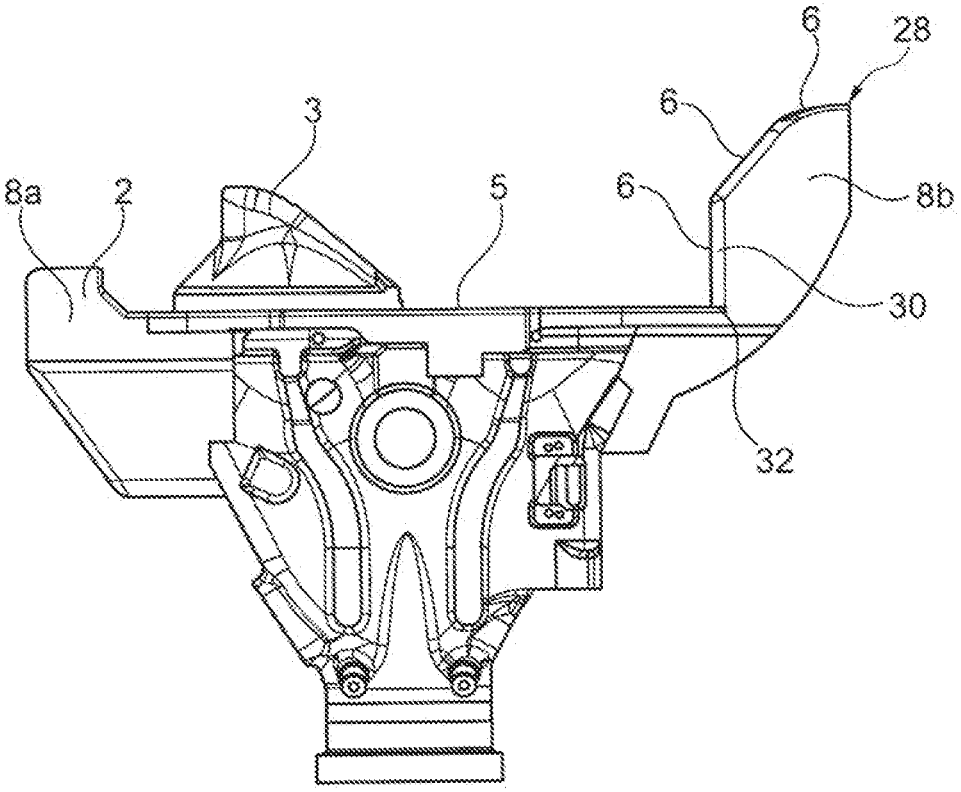
FIG. 5 shows a bottom view onto the coupler of FIG. 3.
Figure 6:
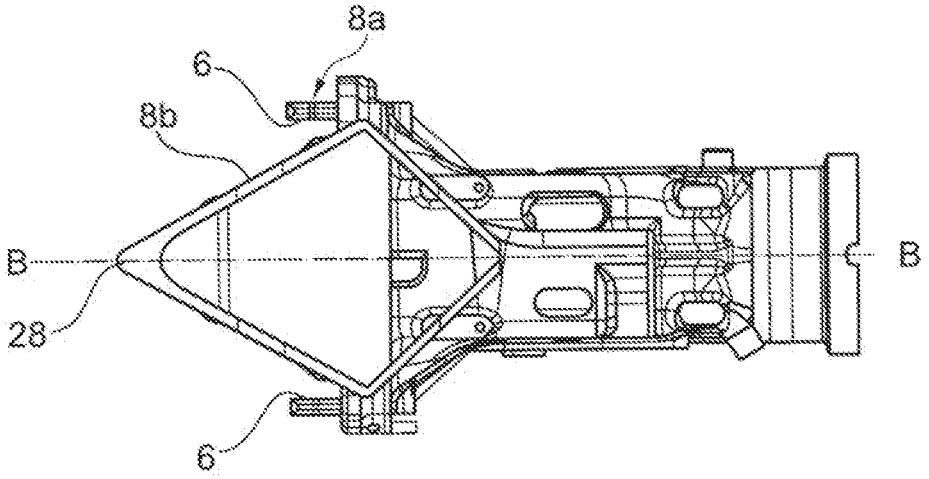
FIG. 6 shows a side view onto the coupler of FIG. 3.
Figure 7:
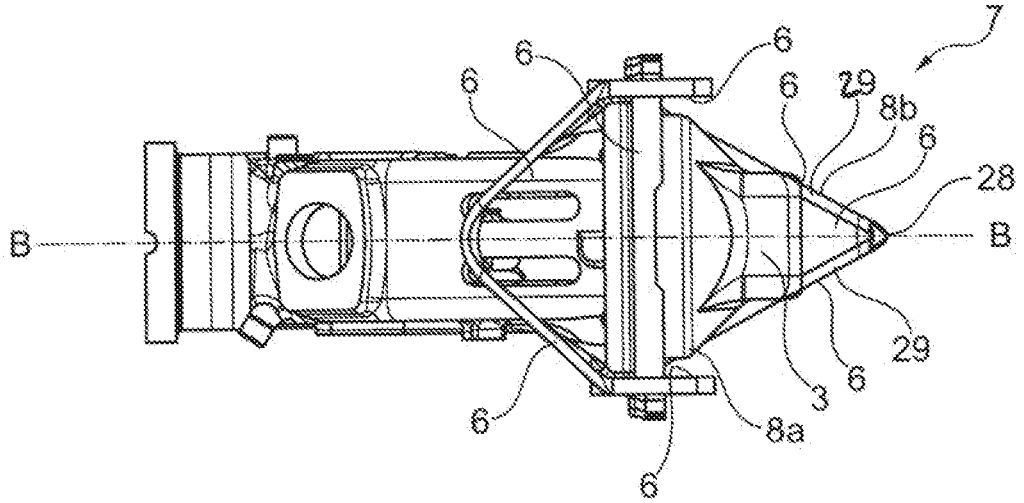
FIG. 7 shows a side view onto the coupler of FIG. 3.
Figure 8:
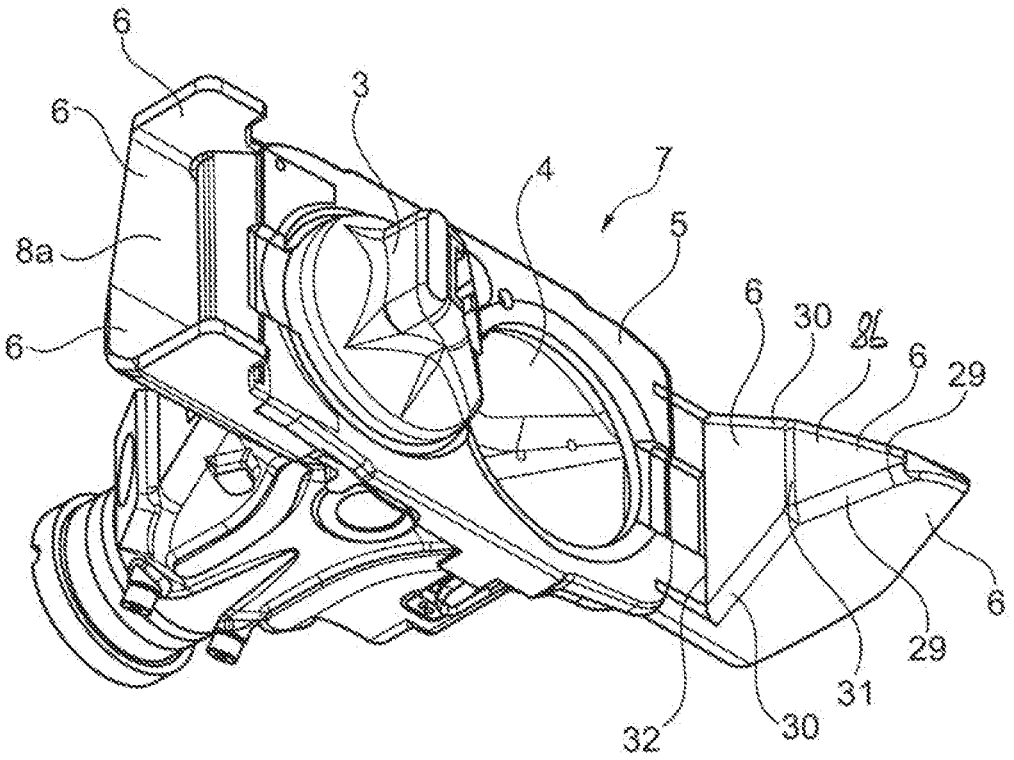
FIG. 8 shows a perspective onto the coupler of FIG. 3 from a first perspective.
Figure 9:
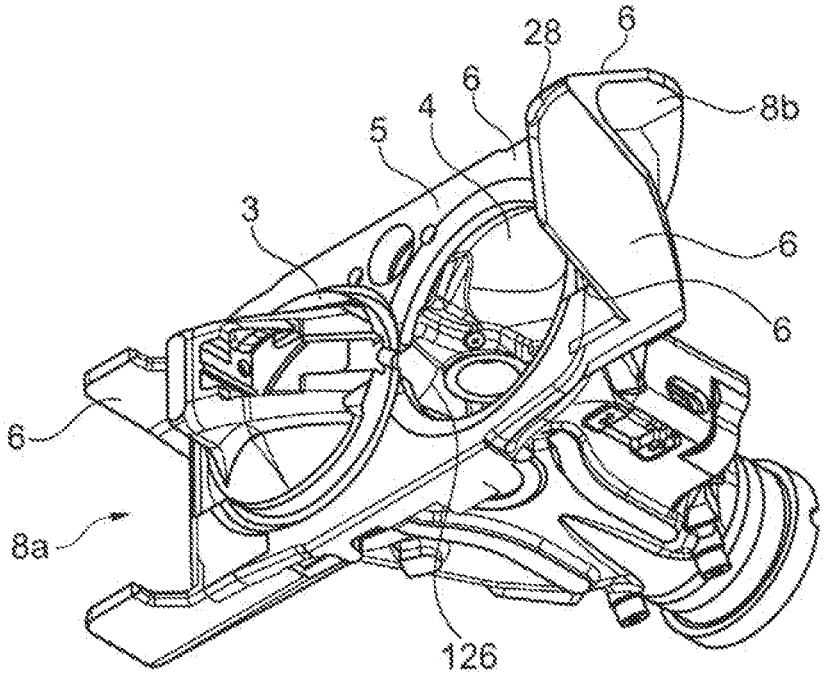
FIG. 9 shows a perspective onto the coupler of FIG. 3 from a second perspective.
Figure 10:
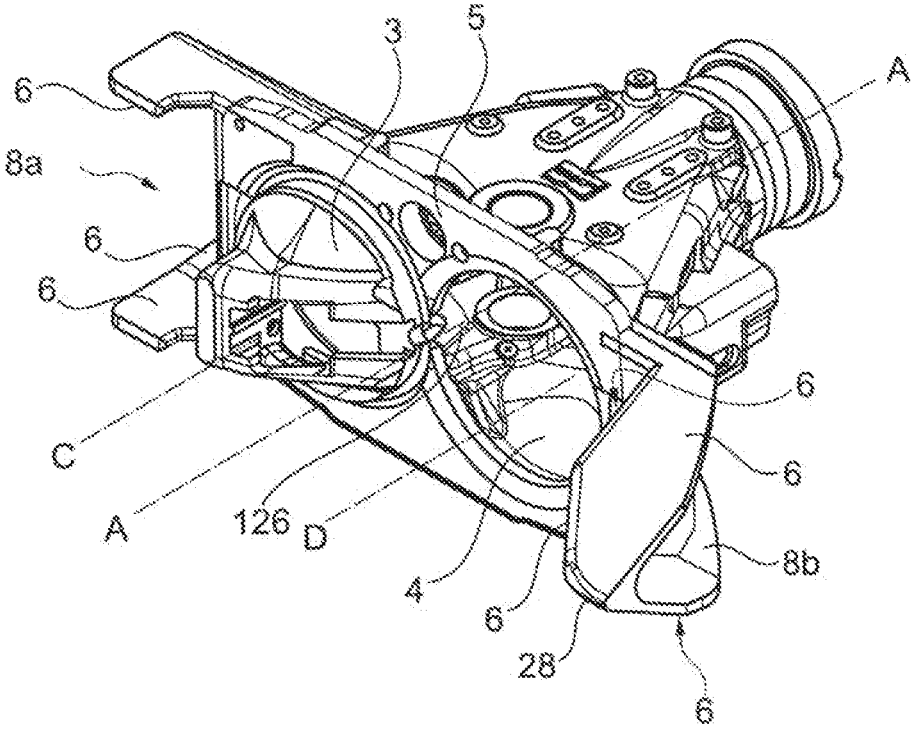
FIG. 10 shows a perspective onto the coupler of FIG. 3 from a third perspective.
Figure 11:
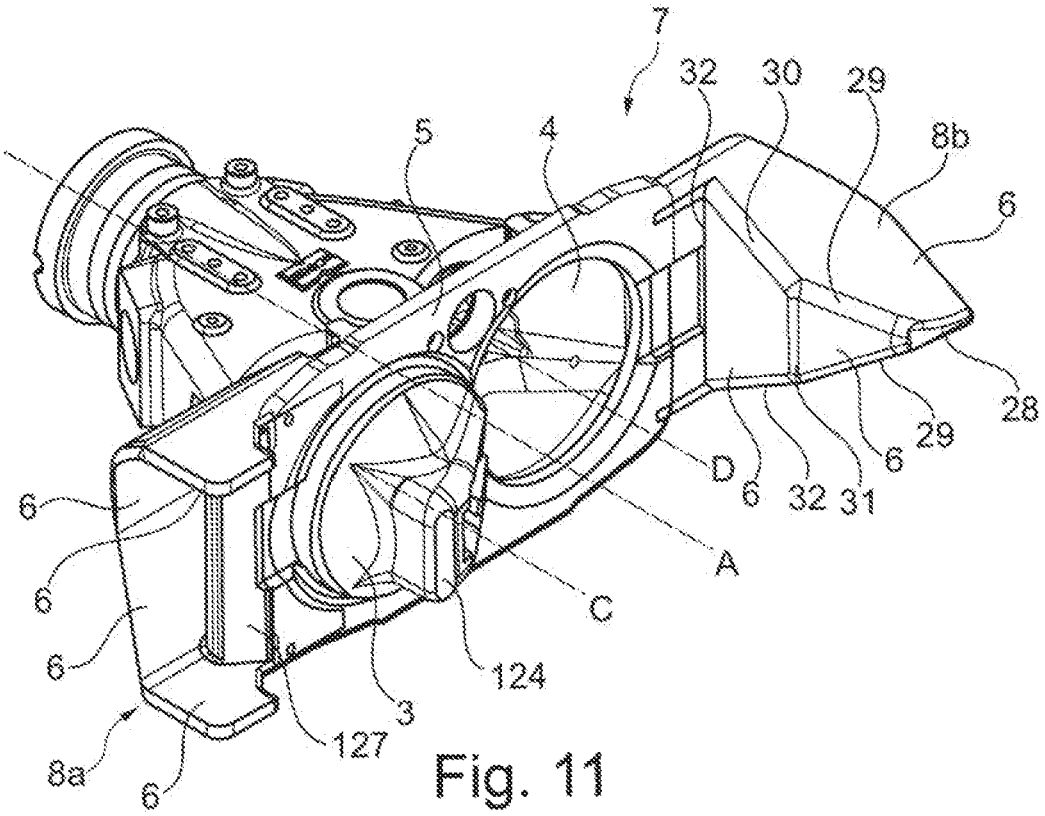
FIG. 11 shows a perspective onto the coupler of FIG. 3 from a fourth perspective.
Figure 12:
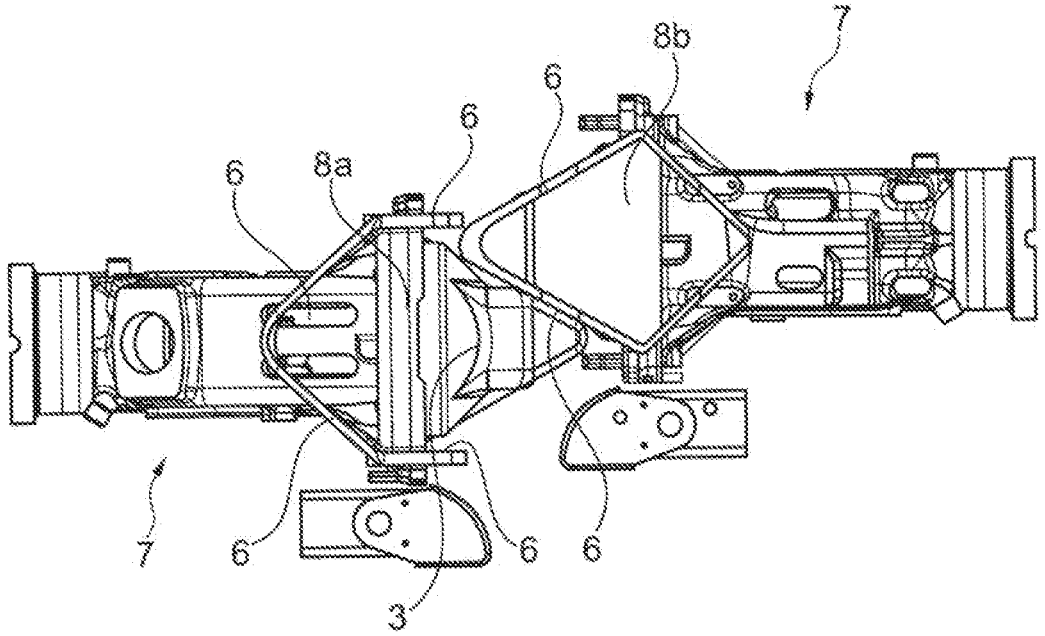
FIG. 12 shows a side view onto a coupler system according to the invention with a first coupler and a second coupler in a misaligned position during performance of the method according to the invention.
Figure 13:
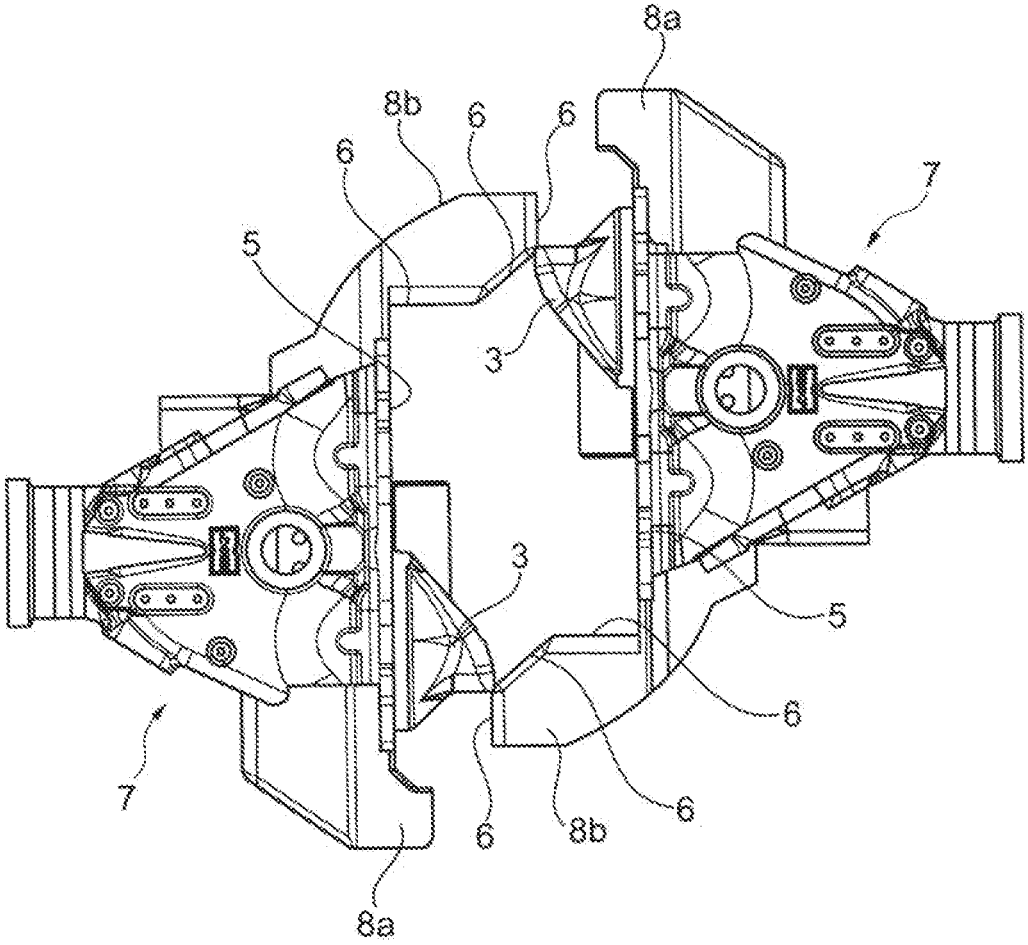
FIG. 13 shows a top view onto a coupler system according to an embodiment of the invention with a first coupler and a second coupler in a misaligned position that is different to the position shown in FIG. 12 during performance of the method according to an embodiment of the invention.
Figure 14:
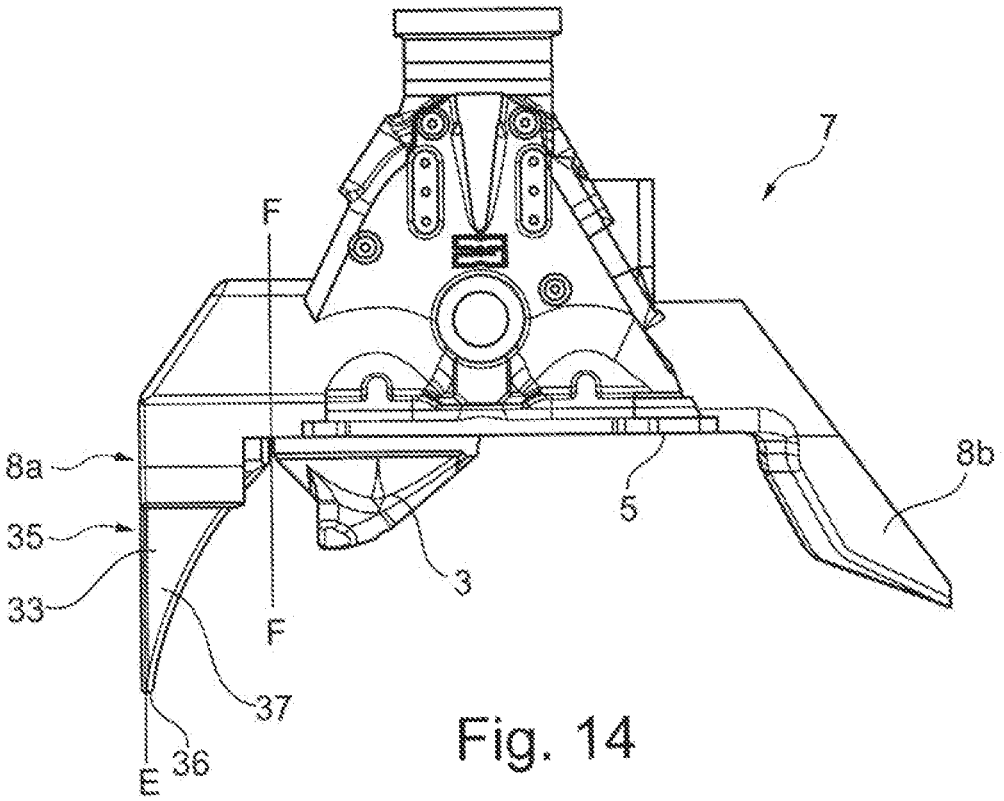
FIG. 14 shows a top view onto a further coupler having a coupler interface according to an embodiment of the invention.
Figure 15:
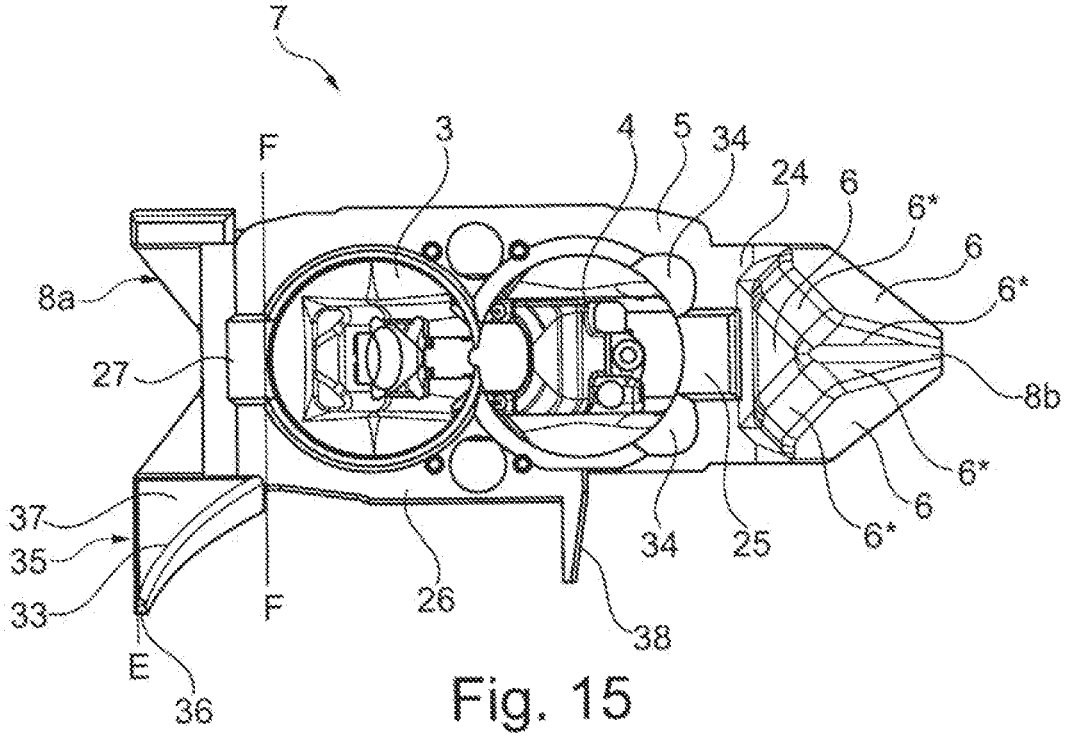
FIG. 15 shows a front view onto the coupler according to FIG. 14.
Figure 16:
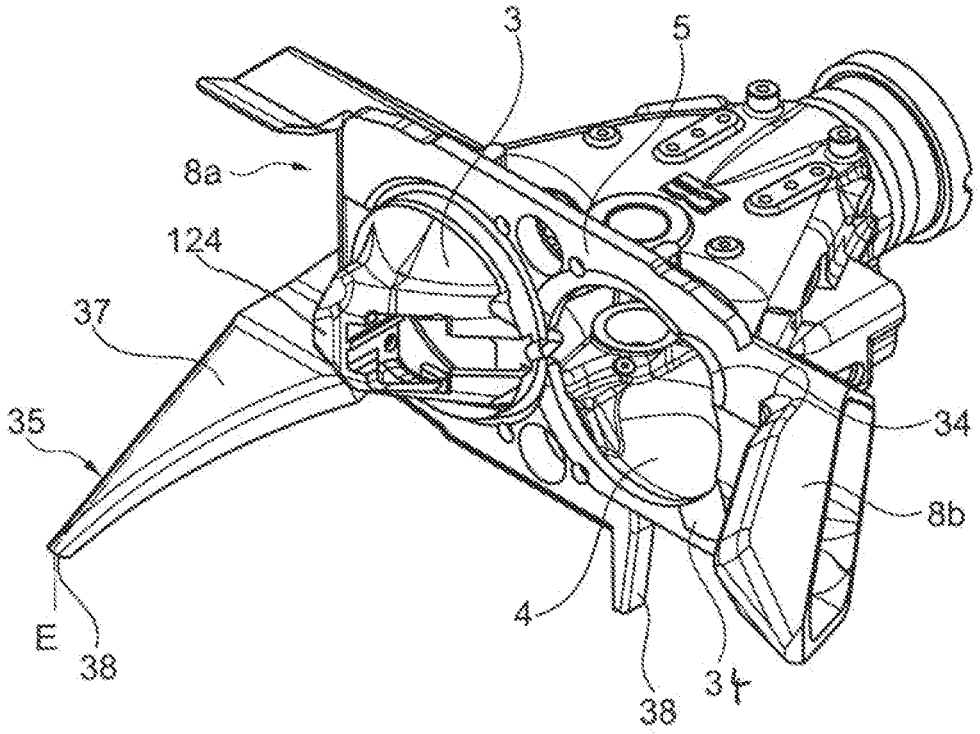
FIG. 16 shows a perspective view onto the coupler according to FIG. 14.
Figure 17:
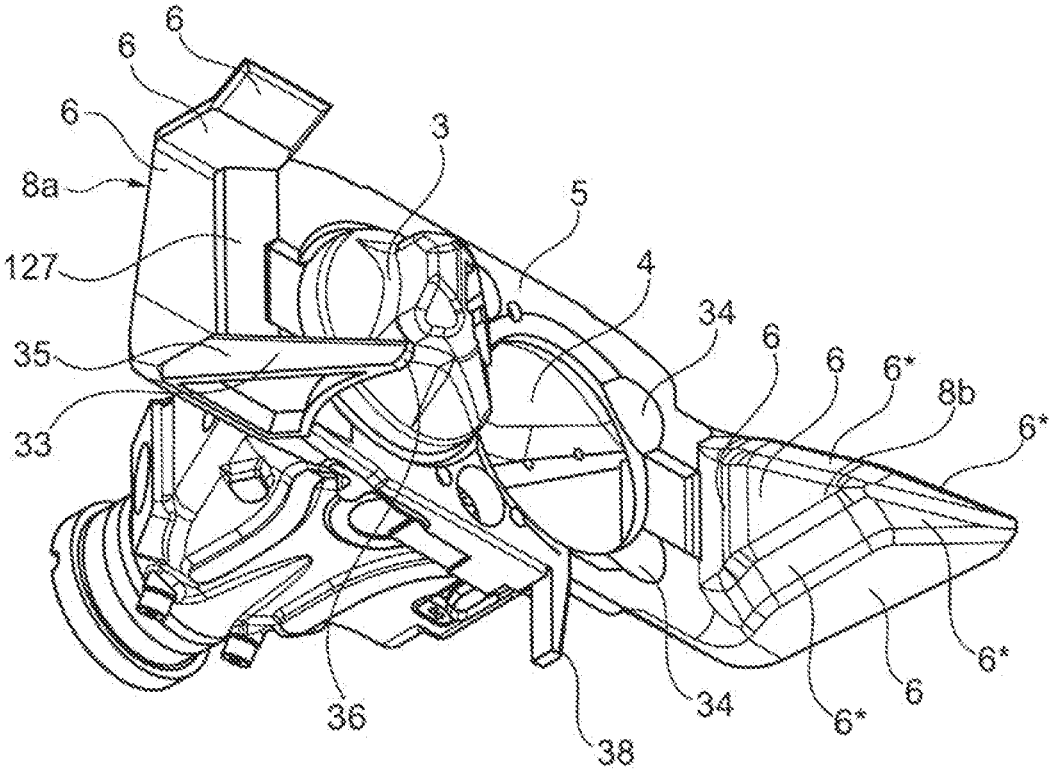
FIG. 17 shows a further perspective view onto the coupler according to FIG. 14.

FIG. 2 shows a coupler 7 having a front surface 5. The front surface 5 comprises a cone 3 and a funnel 4 or cup. An axis M connects the mid points of cone 3 and funnel 4. Lateral to the cone 3 and the funnel 4, for example in the direction of axis M, two guiding elements 8*a*, and 8*b* are provided on the front surface 5.

The two guiding elements 8*a*, 8*b* are provided with the front face 5 in one piece. In the embodiment shown the front surface and the guiding elements 8*a*, 8*b* are casted as one piece.

The height of the coupler 7 shown in FIG. 2 in the direction perpendicular to the axis M, for example axis H, is smaller than 200 mm from center line M to top of coupling interface. Thus, the height of the coupler interface is, i.e. the front surface 5, substantially 2H.

Further, an electrical connector 9 is shown in FIG. 2 which is positioned below the cone 3 and funnel 4, for example below the axis M.

The two guiding elements 8*a*, 8*b* are laterally arranged to the cone 3 and the funnel 4. Each of the guiding elements 8*a*, 8*b* is symmetric to the axis M. The two guiding elements 8*a*, 8*b* are designed to be complement to each other, wherein the guiding element 8*a* has a clamp-like design (a socket design) and can embrace the guiding element 8*b* which has a tooth-shaped design (design of a pyramid). The guiding element 8*b* comprises at least one, especially two, more especially three, even more especially four, sliding surfaces 6 or guide surfaces 6, each of which can span a plane. The guiding element 8*a* comprises at least one, especially two, sliding surfaces 6 or guide surfaces 6.

The clamp-like guiding element 8*a* is arranged on the side of the cone 3 (near to the cone 3), whereas the other guiding element 8*b*, which has a tooth-shaped design, is arranged on the side of the funnel 4 (near to the funnel 4).

The coupler 7 has a front piece 20. The front piece 20 is the forward wall of a basic piece 21 of the coupler 7. The basic piece 21 further contains the rear end 22 and the intermediate part 23. The front surface 5 is the front surface of the front piece. The basic piece 21 is produced as one piece, namely by way of casting.

The front surface 5 is made up of a group of flat surface sections 24, 25, 26, 27, whereby the flat surface sections 24, 26, 27 are arranged in a first plane and the flat surface sections 25, 27 are arranged in a second plane that is arranged parallel to the first plane, but further away from the rear end 22 than the first plane.

The first plane and the second plane are arranged parallel to the longitudinal axis A of the coupler.

The front piece 20 has a rectangular shape. Through holes are be provided in the front piece 20.

The protruding cone 3 extends along a cone axis C. The cone 3 has a circular cross section at the place where it joins the front piece 20, the cone axis is the center axis of this circular cross section. The cup 4 has a cup axis D, which is parallel to the cone axis C. The cup 4 has a circular shape at its starting point on the front surface 5, the cup axis is the center line of this circle. The coupler has a longitudinal axis A that extends from the rear end to the coupler interface 5. The cone axis C and the cup axis C are parallel to the longitudinal axis A.

The coupler 7 has at least the guiding elements 8*a*, 8*b*, which each are designed to be symmetric to an axis M connecting the mid of the cone 3 and the mid of the cup 4, namely a horizontal axis M that connects the mid of the cone 3 and the mid of the cup 4; and symmetric relative to a horizontal plane B that contains the mid of the cone 3 and contains the mid of the cup 4.

The protruding cone 3 has the shape of a truncated cone; the truncated cone has a plane face surface 124.

The cone 3 has a circular cross section at the place where it starts to protrude from the front surface 5; the mid of the cone 3 is the center of this circle. The cup 4 has a circular shape at its starting point on the front surface 5, the mid of the cup 4 is the center of this circle.

The protruding cone has a moveable hook 125 (only shown in FIG. 1 and left out in FIG. 2 for reasons of a clearer picture) that can be moved sideways out of the cone 3 towards the cup 4 in a rotational manner.

The cup 4 has the inverted shape of the cone 3. The cup 4 has a sideways opening 126, which is designed to take up the hook 125 that protrudes sideways from the protruding cone 3 of the further coupler 7 and is intended to interlock with the respective coupler 7 by way of being moved sideways out of the protruding cone 3 of the further coupler 7 and into the sideways opening 126 that is provided for it in the cup 4 of the respective coupler 7. The sideways opening 126 is arranged at that side of the cup 4 that is closest to the cone 3. The sideways opening 126 opens towards a space behind the cone 3.

The socket-type guiding element 8*a* is further delimited by a side plate 127, that passes over into the front surface 5. The socket is open towards the side.

The protruding guiding element 8*b* has two flat guide surfaces 6 that run at an angle relative to each other. The two flat guide surfaces 6 run at an angle towards a horizontal plane B, namely run at the same, but inverse angle to the horizontal plane B. The two flat guide surfaces 6 meet in said horizontal plane B forming a front edge 28 that has an edge line that runs along the plane B.

The protruding guiding element 8*b* has a third guide surface 6 that is arranged symmetrically about the horizontal plane B and is arranged in a vertical plane. The vertical plane is arranged at an angle to the linear axis A of the coupler 7. The third guide surface has edges 29 that connect the third guide surface 6 with the other two guide surfaces 6. The third guide surface 6 has a triangular shape.

The protruding guiding element 8*b* has a fourth guide surface 6 that is arranged symmetrically about the horizontal plane B and is arranged in a vertical plane. The vertical plane is arranged parallel to the linear axis A of the coupler. The fourth guide surface 6 has edges 30 that connect the fourth guide surface 6 with the other two guide surfaces 6. The fourth guide surface 6 has an edge 31 that connect the fourth guide surface 6 with the third guide surfaces 6. This edge 31 is a crest. The fourth guide surface 6 is arranged closer to the front surface 5 than the third guide surface 6. The fourth guide surface 6 joins the front surface at an interface line 32. The interface line 32 at least partially is a linear line. The fourth guide surface 6 has a shape of a trapezium.

FIGS. 14 to 28 show a further embodiment of a coupler 7 according to the invention. Like parts have been assigned with the same reference signs as in the embodiment shown in FIGS. 1 to 13. The further embodiment (FIGS. 14 to 28) especially differs from the embodiment shown in FIGS. 1 to 13 in the following design aspects:

- the protruding guiding element 8*b* has been with intermediate guide surface 6* in addition to the existing guide surface 6;
- the socket-type guiding element 8*a* has a guide horn 33 arranged at a lower side corner of the coupler interface 5 that forms part of the one guiding element 8*a;*
- the cup 4 has been provided with pockets 34 that facilitate the entry of a misaligned cone 3 into the cup 4. The socket-type guiding element 8*a* is further delimited by a side plate 27, that passes over into the front surface 5. The socket is open towards the side.

The guide horn protrudes along a horn axis E, whereby the horn axis E is arranged in a vertical plane, but at an angle ALPHA to the horizontal plane. The angle ALPHA is about 25°.

The guide horn 33 has a side surface 35 that is arranged in a vertical plane. The guide horn 33 has a tip 36. The tip 36 is arranged in the same vertical plane as the side surface 35. The guide horn 33 protrudes from the front surface 5 of the front piece 20. The width of the guide horn 33 decreases with distance from the front surface 5. The guide horn 33 has a triangular top surface 37. On side of the triangular top surface 37 is designed to be bow-shaped or curved which facilitates the guiding of the movement of the respective piece that the guide horn 33 is to interact with in the respective scenario of misalignment.

All elements of the guide horn 33 are arranged on one side of a vertical plane F, whereby the cup 4 and the cone 3 are arranged on the other side of the vertical plane F.

An additional guiding element 38 is provided below the front surface 5 and next to the electrical connector 9 (not shown in FIGS. 14 to 17).

Figure 18:
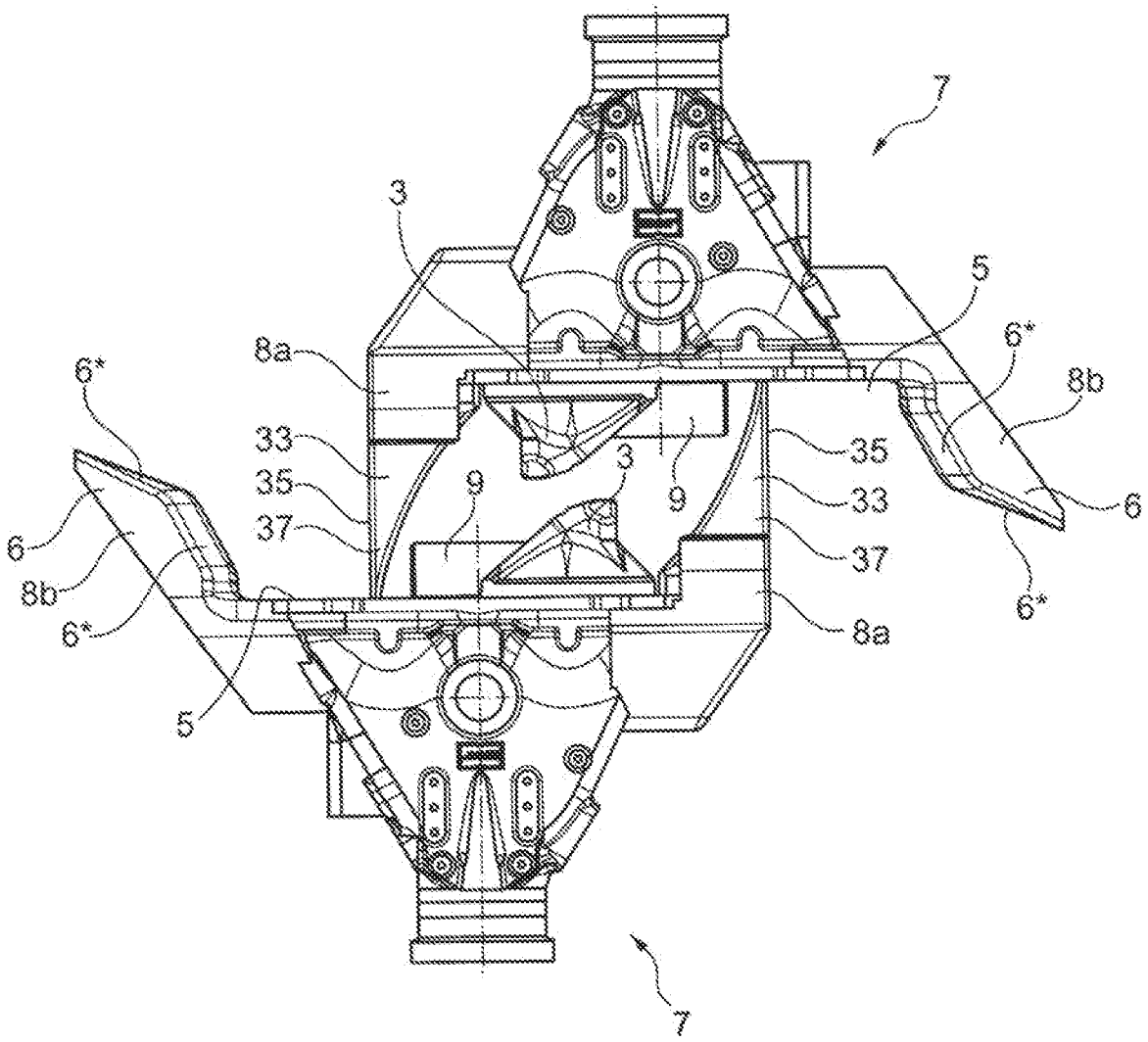
FIG. 18 shows a top view onto a coupler system according to an embodiment of the invention with a first coupler and a second coupler of the type shown in FIGS. 14 to 17 in misalignment during performance of the method according to the invention.
Figure 19:
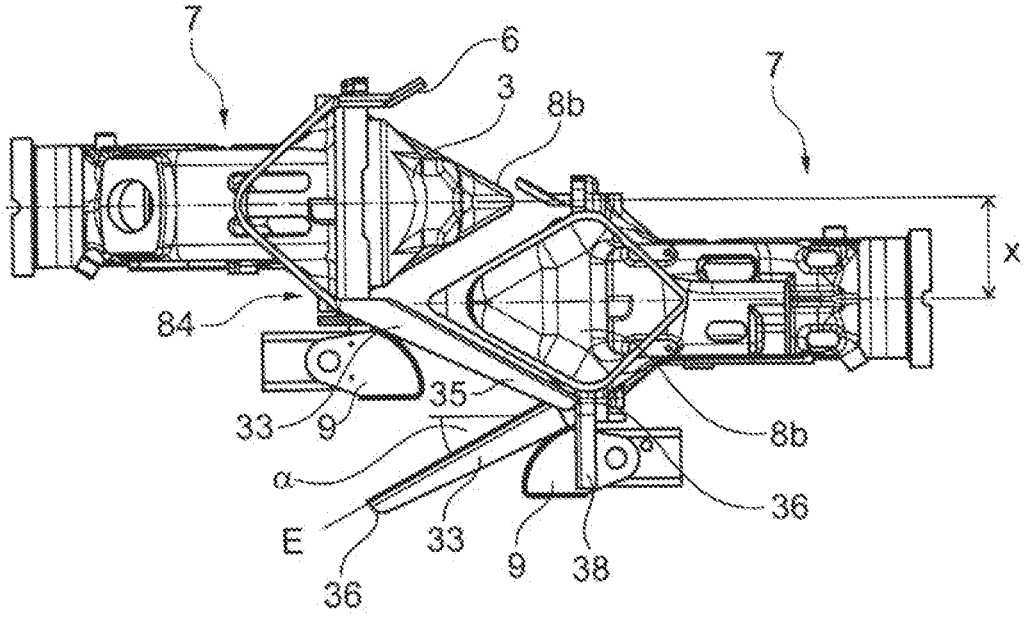
FIG. 19 shows a side view onto a coupler system according to an embodiment of the invention with a first coupler and a second coupler of the type shown in FIGS. 14 to 17 in misalignment during performance of the method according to the invention.
Figure 20:
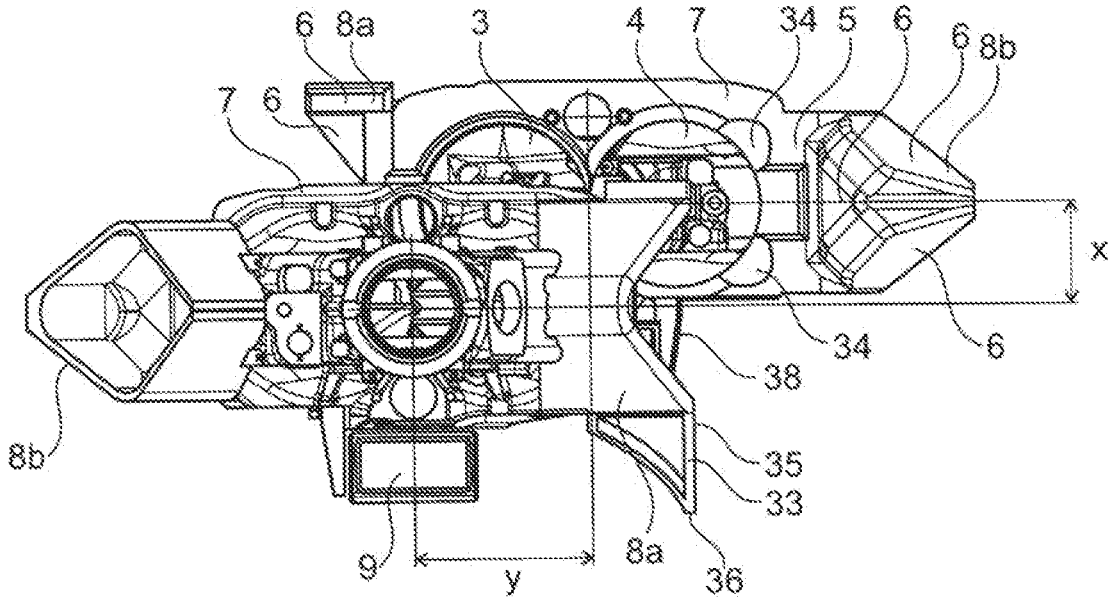
FIG. 20 shows a rear view onto a coupler system according to an embodiment of the invention with a first coupler and a second coupler of the type shown in FIGS. 14 to 17 in misalignment during performance of the method according to the invention.
Figure 21:
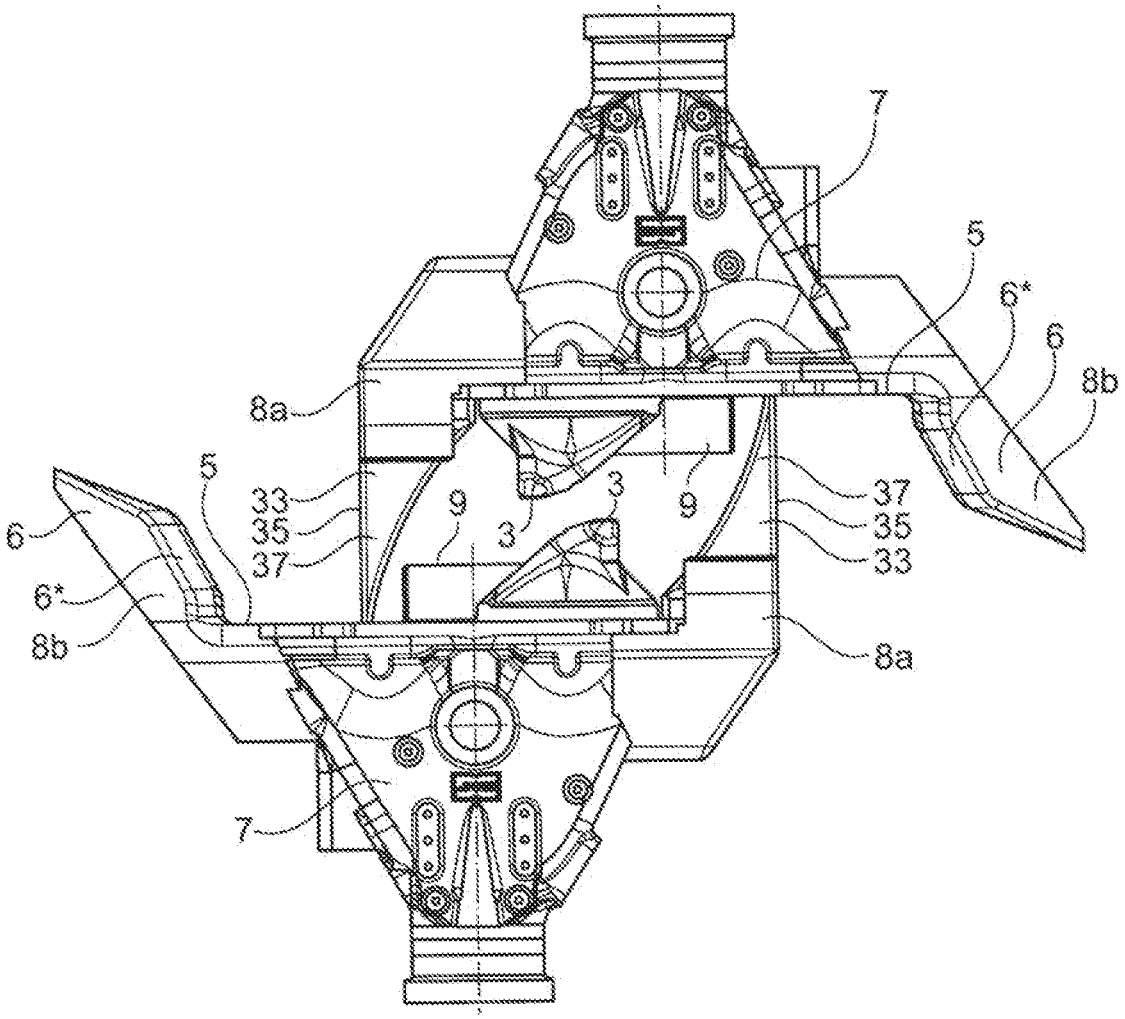
FIG. 21 shows a top view onto a coupler system according to an embodiment of the invention with a first coupler and a second coupler of the type shown in FIGS. 14 to 17 in misalignment during performance of the method according to the invention.

FIGS. 18, 19, 20, 21 and 23 show the first coupler 7 and the second coupler 7 in the same misaligned position. As can be seen from FIG. 18, the lower coupler 7 in the view of FIG. 18 and FIG. 21 is arranged too far to the left hand side relative to the upper coupler 8 in the view of FIG. 18. As can be seen from FIG. 19, the left coupler 7 in the view of FIG. 19 (which is the lower coupler 7 in the view of FIG. 18 and which is the lower, more leftward coupler in FIG. 20) is arranged to high up relative to the right hand coupler 7. If the couplers 7 are moved closer together, the guide horn 33 of the lower coupler 7 in the view of FIG. 18 will come into contact with a lower edge of the front piece 20 of the upper coupler 7 in the view of FIG. 18. Due to the angular arrangement of the guide horn 33 (angle ALPHA) and due to the triangular shape of the top surface 37, further movement of the couplers 7 together will move the upper coupler (in the view of FIG. 18, which is the right hand coupler in FIG. 19) upwards (in the view of FIG. 19) and to the left (in the view of FIG. 18). This will bring the couplers 7 into the aligned position shown in FIG. 28. As has been highlighted in FIG. 20, the couplers 7 are misaligned in the vertical by an amount X, which maybe 125 mm for example, and are misaligned in the horizontal by an amount Y, which may be 220 mm for example.

Figure 22:
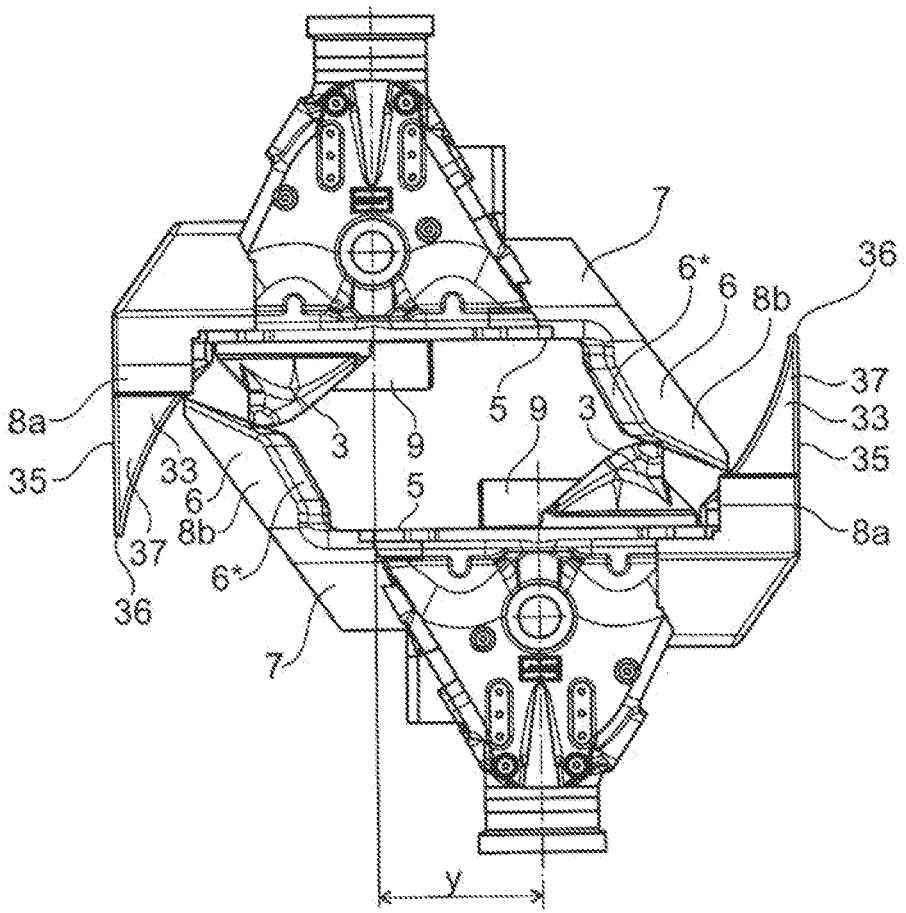
FIG. 22 shows a top view onto a coupler system according to an embodiment of the invention with a first coupler and a second coupler of the type shown in FIGS. 14 to 17 in misalignment during performance of the method according to the invention.
Figure 23:
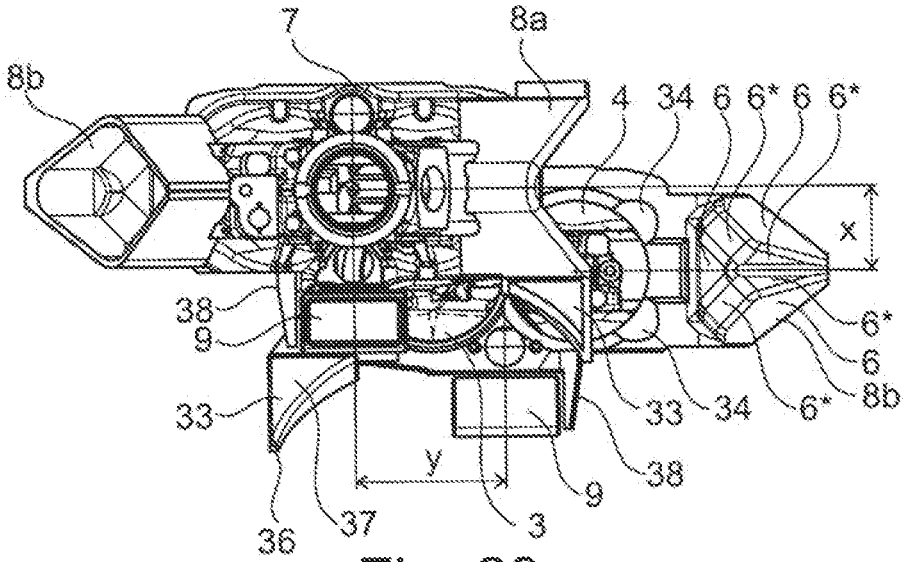
FIG. 23 shows a rear view onto a coupler system according to an embodiment of the invention with a first coupler and a second coupler of the type shown in FIGS. 14 to 17 in misalignment during performance of the method according to the invention.
Figure 24:
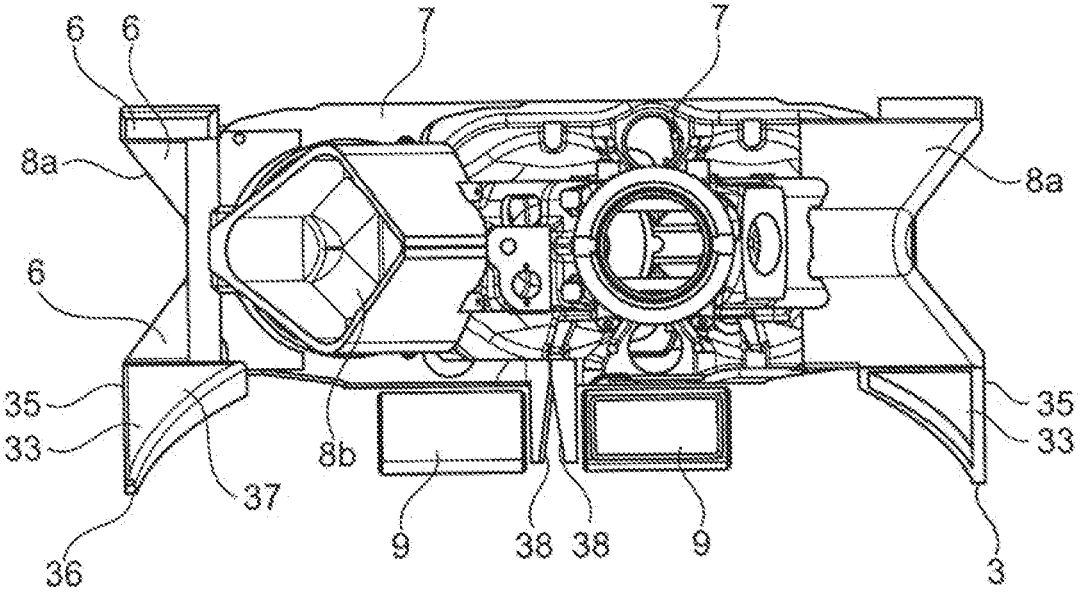
FIG. 24 shows a rear view onto a coupler system according to an embodiment of the invention with a first coupler and a second coupler of the type shown in FIGS. 14 to 17 in misalignment during performance of the method according to the invention.

In the arrangement shown in FIGS. 22 and 24 the couplers 7 are arranged on the same height (see FIG. 24) but misaligned in the sense that the one coupler 7 is too far left relative to the other coupler 7 by the amount y. As can best be seen from FIG. 22, the respective cone 3 of the respective one coupler 7 comes into contact with the guide surfaces 6 of the guiding element 8*b* of the respective other coupler 7. As the couplers 7 are moved closer together, the cones 3 slide along the guide surfaces 6 and are guided by them into the cup 4. As has been highlighted in FIG. 22, the couplers 7 are misaligned in the horizontal by an amount Y, which may be 220 mm for example.

Figure 25:
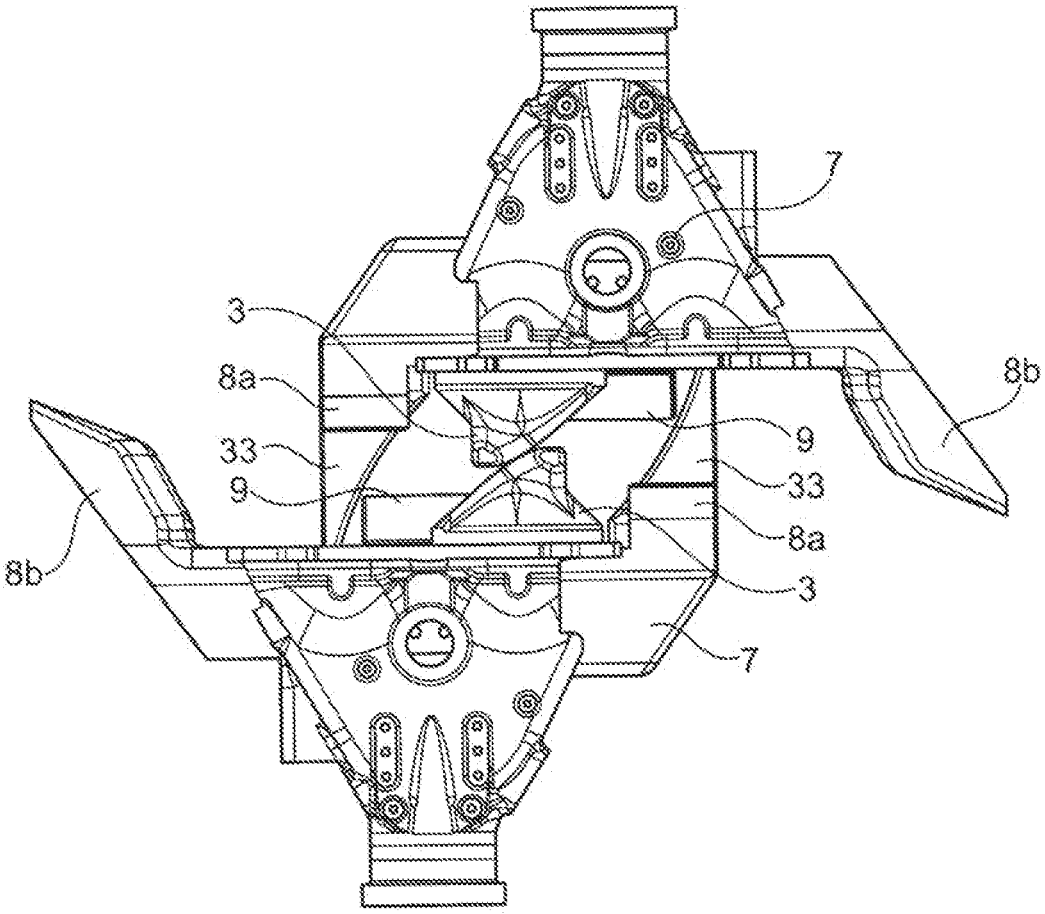
FIG. 25 shows a top view onto a coupler system according to an embodiment of the invention with a first coupler and a second coupler of the type shown in FIGS. 14 to 17 in misalignment during performance of the method according to the invention.

In the arrangement shown in FIG. 25 the couplers 7 are arranged on the same height but misaligned in the sense that the one coupler 7 is too far left relative to the other coupler 7. The respective cone 3 of the respective one coupler 7 comes into contact with the respective cone 3 of the respective other coupler 7. As the couplers 7 are moved closer together, the cones 3 slide along each other and are guided into the cup 4.

Figure 26:
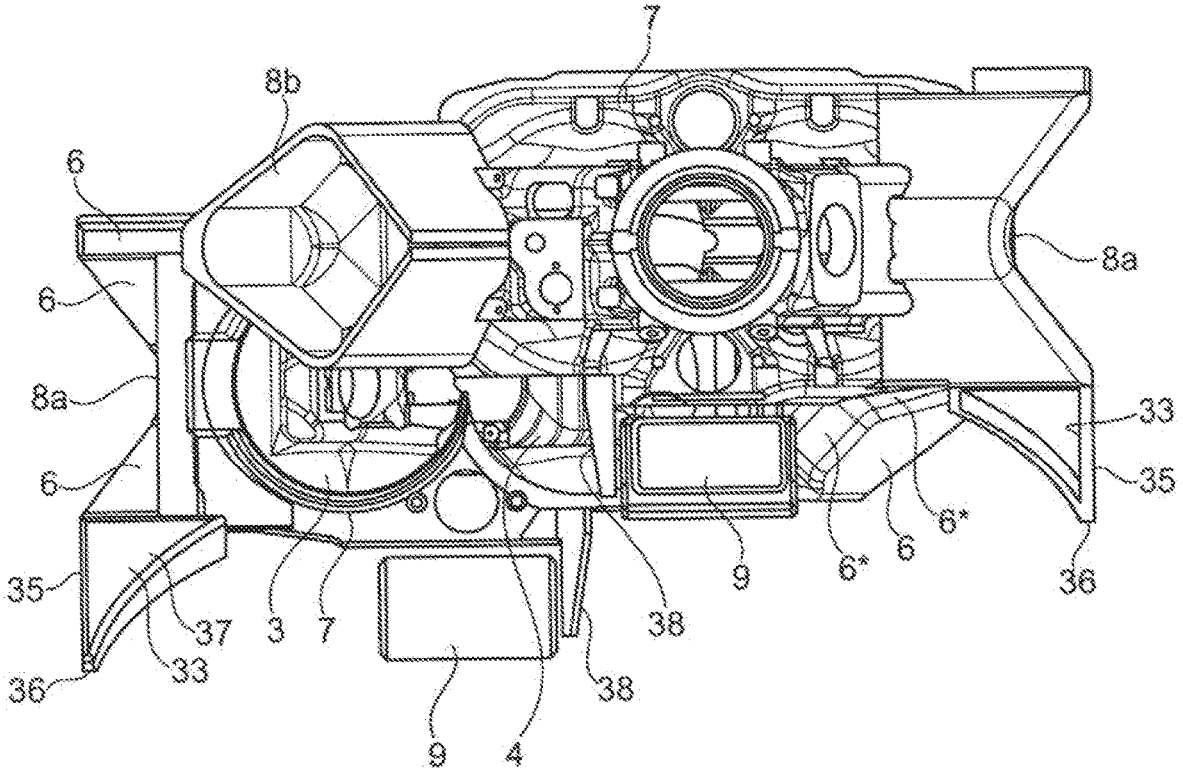
FIG. 26 shows a rear view onto a coupler system according to an embodiment of the invention with a first coupler and a second coupler of the type shown in FIGS. 14 to 17 in misalignment during performance of the method according to the invention.
Figure 27:
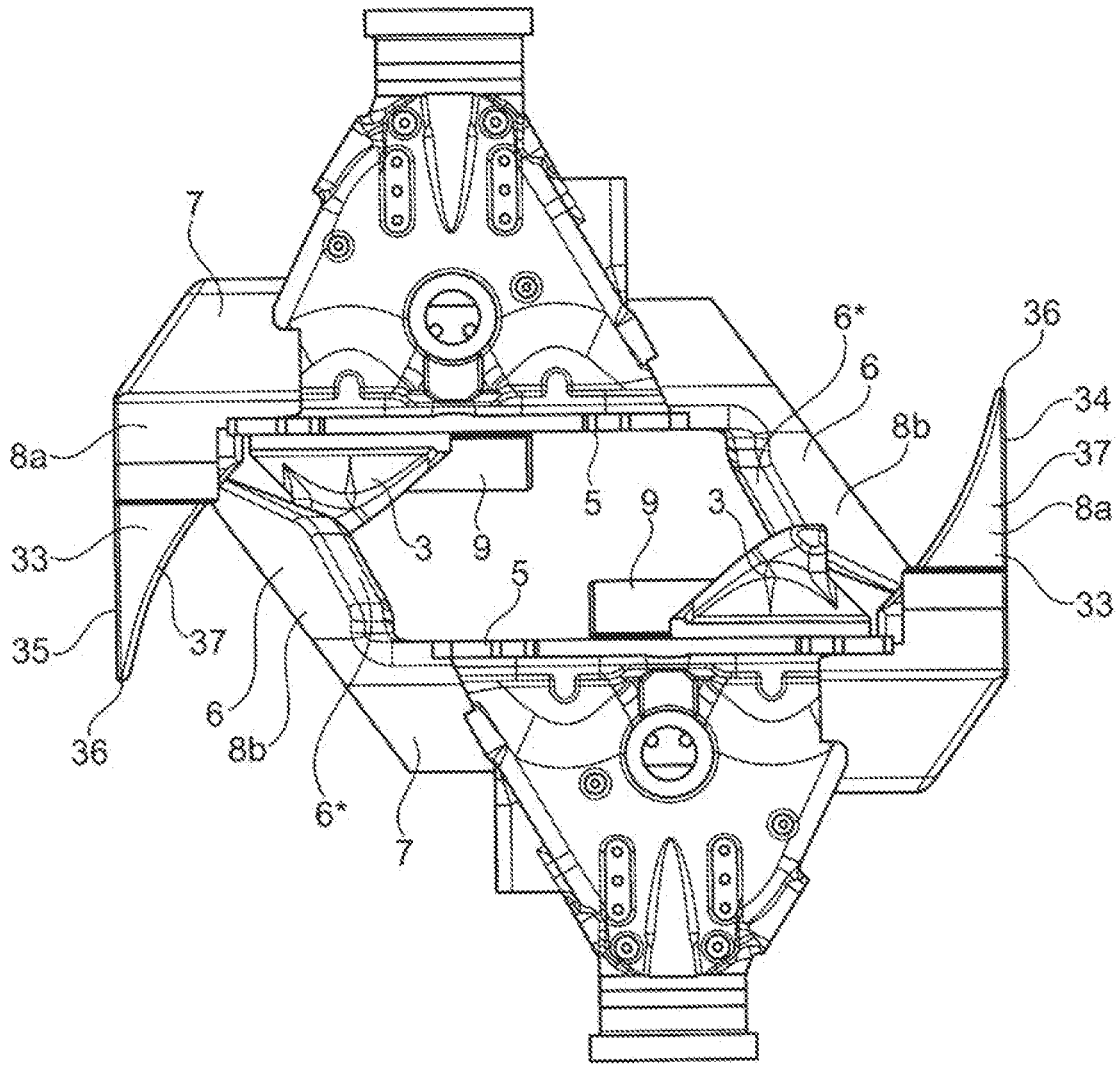
FIG. 27 shows a top view onto a coupler system according to an embodiment of the invention with a first coupler and a second coupler of the type shown in FIGS. 14 to 17 in misalignment during performance of the method according to the invention.

FIGS. 26 and 27 shows a scenario, where the couplers 7 are both misaligned in the vertical (by an amount x that may be 125 mm for example) and the horizontal (by an amount Y that may be 220 mm for example). The misalignment is such that the guiding element 8*b* of the front coupler 7 (the coupler arranged higher and more to the right in FIG. 26) will come into contact with the top guide surface 6 of the guiding element 8*a*. The guiding element 8*b* will slide along the top guide surface 6 of the guiding element 8*a* bringing the front coupler 7 downwards and leftwards. Also, the guide horn 33 will come into contact with the downward facing guide surface 6 of the guiding element 8*b* and slide along it.

Figure 28:
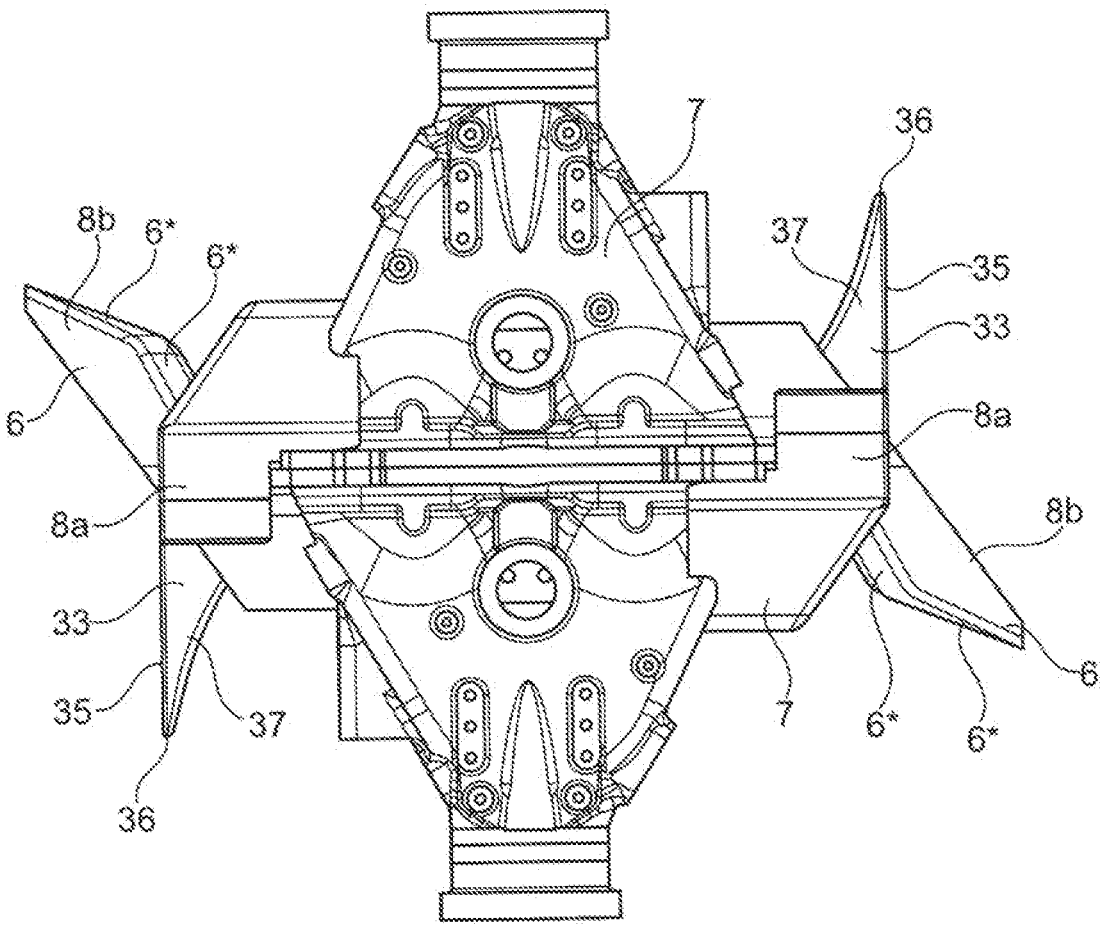
FIG. 28 shows a top view onto a coupler system according to an embodiment of the invention with a first coupler and a second coupler of the type shown in FIGS. 14 to 17 being in the coupled state.

FIG. 28 shows the two couplers in aligned position and coupled. FIG. 28 highlights how the guiding element 8*a* by way of being in a shape of a socket takes up the guiding element 8*b* in the coupled stage.

According to the method for coupling the first coupler 7 of the coupler system according to an embodiment of the invention with a second coupler 7 of the coupler system according to the invention, the following steps are provided:

- providing the first coupler 7 and the second coupler 7, whereby the first coupler 7 is spaced apart from the second coupler 7,
- moving the first coupler 7 towards the second coupler 7 and/or moving the second coupler 7 towards the first coupler 7,
- bringing
  - a. the protruding cone 3 of the first coupler 7 into contact with a guiding element 8*a*,8*b* of the second coupler 7 (see for example FIG. 13) and/or
  - b. the protruding cone 3 of the second coupler 7 into contact with a guiding element 8*a*,8*b* of the first coupler 7 (see for example FIG. 13) and/or
  - c. bringing a guiding element 8*a* of the first coupler 7 into contact with a guiding element 8*b* of the second coupler 7 (see for example FIG. 12), further moving the first coupler 7 towards the second coupler 7 and/or further moving the second coupler 7 towards the first coupler 7, moving the protruding cone 3 of the first coupler 7 into the matching cup 4 of the second coupler 7 and the protruding cone 3 of the second coupler 7 into the matching cup 4 of the first coupler 7.

FIGS. 2 to 28 show the coupler(s) 7 only with the unitary casted basic piece of the coupler 7 with additional elements of the coupler, like the hook 125 not being shown in the FIGS. 2 to 28 to facilitate the presentation of the features of the coupler 7. The electrical coupler 9 also is not shown in FIGS. 3 to 11 and 14 to 17 to facilitate the presentation of the features of the coupler 7.

It is understood that all presented embodiments are only exemplary, and that any feature presented for a particular example embodiment may be used with any aspect of the invention on its own or in combination with any feature presented for the same or another particular example embodiment and/or in combination with any other feature not mentioned. It will further be understood that any feature presented for an example embodiment in a particular category (method/apparatus/system) may also be used in a corresponding manner in an example embodiment of any other category. Those skilled in the art should appreciate that they may readily use the present disclosure as a basis for designing or modifying other processes and structures for carrying out the same purposes and/or achieving the same advantages of the embodiments introduced herein. Those in the art will recognize that other embodiments may be practiced with modifications and alterations limited only by the claims.

What is claimed is:

1. A coupler having a coupler interface with a top, a bottom, and a center line centrally between the top and the bottom, the coupler interface comprising a protruding cone, a matching cup and at least two guiding elements, wherein a height of the coupler from the center line of the coupler interface to the top of the coupler interface is smaller than 200 millimeters (mm), wherein two of the at least two guiding elements are laterally arranged to the cone and the cup, wherein the lateral arrangement of one of the two guiding elements is proximal to the cone and distal to the cup and the lateral arrangement of another one of the two guiding elements is distal to the cone and proximal to the cup; wherein one of the two guiding elements has a clamp-like design and another one of the two guiding elements has a tooth-shaped design such that, when a first and a second of the couplers are coupled together, the guiding element having the clamp-like design of the first coupler is adapted to embrace the guiding element having the tooth-shaped design of the second coupler, and the guiding element having the clamp-like design of the second coupler is adapted to embrace the guiding element having the tooth-shaped design of the first coupler.

2. The coupler according to claim 1, wherein the two guiding elements are provided with the coupler interface in one piece.

3. The coupler according to claim 2, wherein the coupler interface is casted and the two guiding elements are formed during casting.

4. The coupler according to claim 1, further comprising an electrical connector arranged on a lower side of the coupler interface.

5. The coupler according to claim 1, wherein one or both of the two guiding elements are symmetric to an axis connecting a mid of the cone and a mid of the cup.

6. The coupler according to claim 1, wherein the two guiding elements are configured to complement each other.

7. The coupler according to claim 1, wherein at least one of the two guiding elements comprises at least one guide surface that spans a plane.

8. The coupler according to claim 1, wherein at least one of the two guiding elements comprises a socket design.

9. The coupler according to claim 1, further comprising a guide horn arranged at a lower side corner of the coupler interface, wherein the guide horn forms another one of the at least two guiding elements in addition to the two guiding elements.

10. A coupler system comprising:

a first coupler; and a second coupler;

wherein each of said first coupler and second coupler comprises a coupler interface having a top, a bottom, and a center line centrally between the top and the bottom, the coupler interface comprising a protruding cone, a matching cup and at least two guiding elements, wherein a height of the coupler from the center line of the coupler interface to the top of the coupler interface Is smaller than 200 millimeters (mm); wherein two of the at least two guiding elements are laterally arranged to the cone and cup, wherein the lateral arrangement of one of the two guiding elements is proximal to the cone and distal to the cup, and the lateral arrangement of another one of the two guiding elements is distal to the cone and proximal to the cup, wherein one of the two guiding elements has a clamp- like design and another one of the two guiding elements has a tooth-shaped design; and wherein when the first and second couplers are coupled together; (a) the protruding cone of the first coupler is arranged in the matching cup of the second coupler, and the protruding cone of the second coupler is arranged in the matching cup of the first coupler and (b) the guiding element having the clamp-like design of the first coupler is adapted to embrace the guiding element having the tooth-shaped design of the second coupler, and the guiding element having the clamp-like design of the second coupler is adapted to embrace the guiding element having the tooth-shaped design of the first coupler.

11. The coupler system according to claim 10, wherein the protruding cone of the first coupler has a hook that protrudes sideways out of the protruding cone of the first coupler and into a sideways opening of the cup of the second coupler into a space behind the protruding cone of the second coupler.

12. The coupler system according to claim 10, wherein the protruding cone of the second coupler has a hook that protrudes sideways out of the protruding cone of the second coupler and into a sideways opening of the cup of the first coupler into a space behind the protruding cone of the first coupler.

13. The coupler system according to claim 10, wherein the protruding cone of the first coupler has a hook that protrudes sideways out of the protruding cone of the first coupler and into a sideways opening of the cup of the second coupler into a space behind the protruding cone of the second coupler; and the protruding cone of the second coupler has a hook that protrudes sideways out of the protruding cone of the second coupler and into a sideways opening of the cup of the first coupler into a space behind the protruding cone of the first coupler.

14. A multi-car vehicle comprising:

a first car;

a second car; and a coupler system having a first coupler connected to the first car, and a second coupler connected to the second car;

wherein each of said first coupler and said second coupler comprises a coupler interface having a top, a bottom, and a center line centrally between the top and the bottom, the coupler interface comprising a protruding cone, a matching cup and at least two guiding elements, wherein a height of the coupler from the center line of the coupler interface to the top of the coupler interface is smaller than 200 (mm), wherein two of the at least two guiding elements are laterally arranged to the cone and the cup, wherein the lateral arrangement of one of the two guiding elements is proximal to the cone and distal to the cup, and the lateral arrangement of another one of the two guiding elements is distal to the cone and proximal to the cup, wherein one of the two guiding elements has a clamp-like design and another one of the two guiding elements has a tooth-shaped design; and wherein, when the first car and the second car are connected together, (a) the protruding cone of the first coupler is arranged in the matching cup of the second coupler and the protruding cone of the second coupler is arranged in the matching cup of the first coupler, and (b) the guiding element having the clamp-like design of the first coupler is adapted to embrace the guiding element having the tooth-shaped design of the second coupler, and the guiding element having the clamp-like design of the second coupler is adapted to embrace the guiding element having the tooth-shaped design of the first coupler.

15. The multi-car vehicle of claim 14, wherein the first coupler is attached to an underframe of the first car, and the second coupler is attached to an underframe of the second car.

16. A method for coupling a first coupler of a coupler system to a second coupler of the coupler system, the method comprising the steps of:

providing a first coupler and a second coupler, the first coupler being spaced apart from the second coupler, wherein each of said first coupler and said second coupler comprises a coupler interface having a top, a bottom, and a center line centrally between the top and the bottom, the coupler interface comprising a protruding cone, a matching cup and at least two guiding elements, wherein a height of the coupler from the center line of the coupler interface to the top of the coupler interface is smaller than 200 millimeters (mm), wherein two of the at least two guiding elements are laterally arranged to the cone and the cup, wherein the lateral arrangement of one of the two guiding elements is proximal to the cone and distal to the cup and the lateral arrangement of another one of the two guiding elements is distal to the cone and proximal to the cup, wherein one of the two guiding elements has a clamp-like design and another one of the two guiding elements has a tooth-shaped design;

one or both of moving the first coupler towards the second coupler and/or moving the second coupler towards the first coupler;

one or more of:

bringing the protruding cone of the first coupler into contact with the at least one guiding element of the second coupler, and/or bringing the protruding cone of the second coupler into contact with the at least one guiding element of the first coupler and/or bringing the at least one guiding element of the first coupler into contact with the at least one guiding element of the second coupler;

one or more of further moving the first coupler towards the second coupler, and/or further moving the second coupler towards the first coupler;

moving the protruding cone of the first coupler into the matching cup of the second coupler and the protruding cone of the second coupler into the matching cup of the first coupler.

17. The method according to claim 16, further comprising moving a hook on the cone of the first coupler into a position where the hook protrudes sideways out of the protruding cone of the first coupler and into a sideways opening of the cup of the second coupler into a space behind the protruding cone of the second coupler.

* * * * *